US007422387B2

(12) United States Patent
Kurihara et al.

(10) Patent No.: US 7,422,387 B2
(45) Date of Patent: Sep. 9, 2008

(54) STICK-TYPE COSMETIC PAINT CONTAINER

(75) Inventors: Mitsuru Kurihara, Sayama (JP); Mitsunobu Nakamura, Sayama (JP); Kazutsugu Iwasaki, Sayama (JP); Shigeto Imabeppu, Tokyo (JP); Kei Arai, Tokyo (JP); Tomohiro Okada, Tokyo (JP)

(73) Assignee: KOSE Corporation, Tokyo (JP)

( * ) Notice: Subject to any disclaimer, the term of this patent is extended or adjusted under 35 U.S.C. 154(b) by 411 days.

(21) Appl. No.: 10/522,376

(22) PCT Filed: Jun. 26, 2003

(86) PCT No.: PCT/JP03/08082

§ 371 (c)(1),
(2), (4) Date: Jan. 26, 2005

(87) PCT Pub. No.: WO2004/010820

PCT Pub. Date: Feb. 5, 2004

(65) Prior Publication Data

US 2005/0260025 A1 Nov. 24, 2005

(30) Foreign Application Priority Data

Jul. 29, 2002 (WO) ..... PCT/JP02/07670

(51) Int. Cl.
*B43K 21/08* (2006.01)
*B43K 23/00* (2006.01)

(52) U.S. Cl. ..... 401/78; 401/88

(58) Field of Classification Search ..... 401/75, 401/77, 78, 80, 84, 88
See application file for complete search history.

(56) References Cited

U.S. PATENT DOCUMENTS

| | | | | |
|---|---|---|---|---|
| 3,677,654 | A * | 7/1972 | Davis | 401/63 |
| 4,983,059 | A * | 1/1991 | Holloway | 401/78 |
| 5,988,917 | A | 11/1999 | Sheffler et al. | |
| 6,224,281 | B1 * | 5/2001 | Kim | 401/75 |
| 7,004,656 | B2 * | 2/2006 | Kurihara et al. | 401/75 |
| 2004/0265033 | A1 | 12/2004 | Kurihara et al. | |

FOREIGN PATENT DOCUMENTS

| | | |
|---|---|---|
| CN | 1252964 A | 5/2000 |
| JP | 4-6651 | 2/1992 |
| JP | 4-6653 | 2/1992 |
| JP | 2002-223847 | 8/2002 |

* cited by examiner

*Primary Examiner*—David J Walczak
(74) *Attorney, Agent, or Firm*—Oblon, Spivak, McClelland, Maier & Neustadt, P.C.

(57) ABSTRACT

A stick-type cosmetic container including an outer cylinder, a sleeve, an inner container in which a stick-type cosmetic can be filled, one or more small projections provided on the inner container being guided by an inner container guiding groove formed on the sleeve, the small projection moving upward and downward along a helical groove formed on the inner surface of the outer cylinder, and the stick-type cosmetic filled in the inner container being projected and retracted. The lower end of the inner container guiding groove formed on the sleeve is opened and a retaining mechanism for the small projection is provided at the lower portion of the inner container guiding groove. Refilling and replacement of the stick-type cosmetic container can be performed by the use of a simple jig, and there is no problem of dropping of the inner container when in use.

10 Claims, 26 Drawing Sheets

STICK-TYPE COSMETIC PAINT CONTAINER

TECHNICAL FIELD

The present invention relates to a stick-type cosmetic container and, more specifically, to a stick-type cosmetic container in which only a stick-type cosmetic filled therein can easily be replaced.

BACKGROUND ART

A stick-type cosmetic container in which a stick-type cosmetic filled therein is projected and retracted by rotating an outer cylinder is widely used as a container for lipsticks and other cosmetics such as lip cream and concealer because of its usability or some other reasons.

The stick-type cosmetic container in the related art includes, for example, an outer cylinder 10, a sleeve 2 and an inner container 7 filled with the stick-type cosmetic with an outer decorative cylinder and a lid removed, as shown in FIG. 1*a* and FIG. 1*b*. FIG. 1*b* is a cross-sectional view substantively showing only the inner container 7 (the stick-type cosmetic is not shown), and FIG. 1*a* is a cross-sectional view showing a state in which only the sleeve 2 is removed.

A small projection 8 is provided on the lower portion of the outer surface of the inner container 7, and an inner container guiding groove 3 is formed on the sleeve 2, and a helical groove 11 is formed on the inner surface of the outer cylinder 10. The small projection 8 on the inner container 7 moves upward and downward along the inner container guiding groove 3 on the sleeve 2 in accordance with the rotation of the helical groove 11 on the outer cylinder 10, and the stick-type cosmetic is projected and retracted accordingly.

In this manner, the small projection 8 of the inner container 7 moves upward and downward along the inner container guiding groove 3 of the sleeve 2 in accordance with rotation of the outer cylinder 10. However, if it moves endlessly, the inner container 7 finally drops out of the sleeve 2, and thus it is necessary to limit the movement of the small projection 8 on the inner container 7 to a certain range. Therefore, in the stick-type cosmetic container in the related art, the inner container 7 is prevented from being dropped out by closing both ends of the inner container guiding groove 3 or by avoiding formation of the helical groove 11 to the end of the inner surface of the outer cylinder.

The stick-type cosmetic container in the related art, having such structure described above, has no problem when it is used as a disposable container. However, when refilling or replacing is considered, it is very inconvenient to use. In other words, since the inner container is configured not to be dropped out, replacement of the inner container itself has to be done after disassembling the cosmetic container once.

In recent years, in accordance with widespread movement of resource saving or recycling, cosmetic containers which can be refilled or replaced are preferred. However, as regards the stick-type cosmetic container, the container in which only the stick-type cosmetic can be replaced has not been provided as a matter of fact in above-mentioned reasons.

Therefore, it is an object of the present invention to provide a stick-type cosmetic container in which refilling and replacement can easily be performed, while the risk of dropping of the inner container in normal use can be avoided.

DISCLOSURE OF INVENTION

Having been dedicated to studying means for solving the problems described above, the present inventors completed the present invention from such idea that both of refilling and replacing, and prevention of dropping of the inner container can be realized simultaneously by utilizing such characteristic that the inner container moves upward and downward along one of the inner container guiding groove by the helical groove formed on the inner surface of the outer cylinder.

In other words, the present invention provides a stick-type cosmetic container including an outer cylinder, a sleeve, and an inner container, in which the stick-type cosmetic can be filled, wherein a small projection formed on the inner container is guided along an inner container guiding groove formed on the sleeve, and is moved upward and downward by a helical groove formed on the inner surface of the outer cylinder for projecting and retracting the stick-type cosmetic filled in the inner container, characterized in that the lower end of the inner container guiding groove formed on the sleeve is opened and a retaining mechanism of the small projection is provided on the lower portion of the inner container guiding groove.

The present invention also provides a method of preparing the stick-type cosmetic wherein the stick-type cosmetic container described above is used and the cosmetic is filled from the bottom portion of the container.

BEST MODE FOR CARRYING OUT THE INVENTION

Figures 1A, 1B:
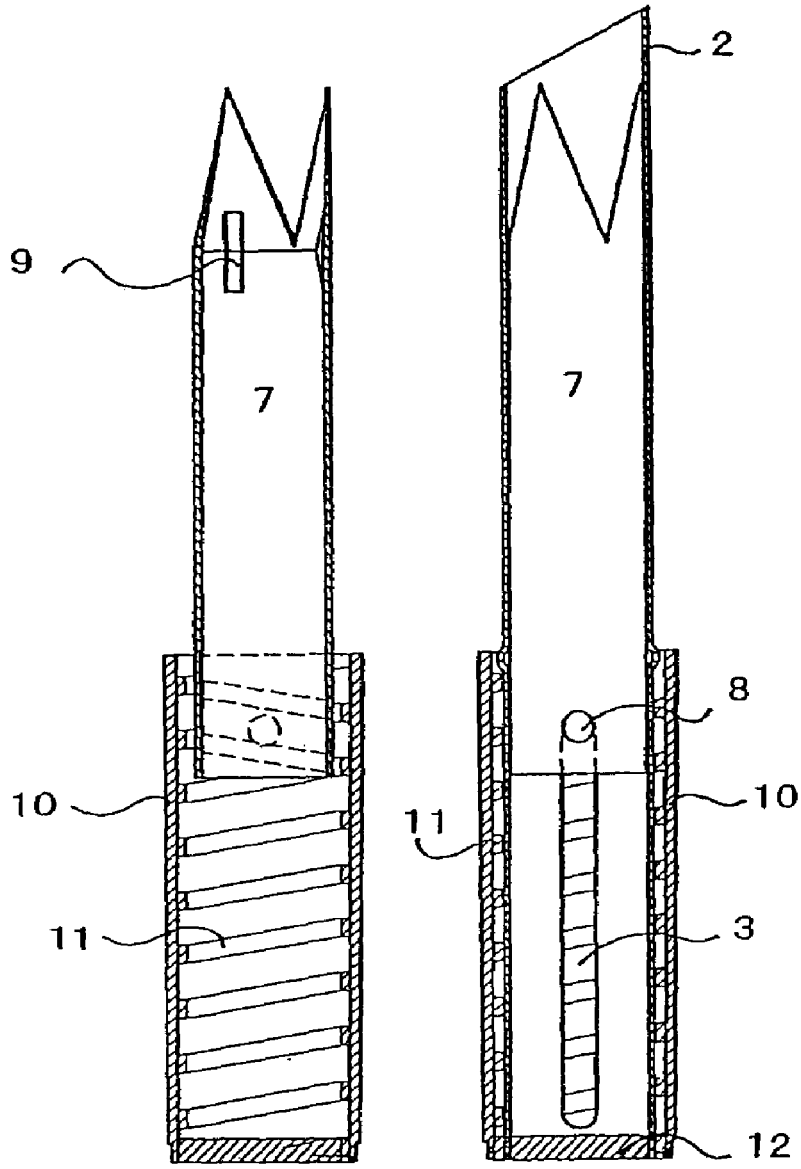
FIG. 1a FIG. 1b RELATED ART
FIGS. 1*a* and 1*b* are drawings showing a structure of a stick-type cosmetic container in the related art.

Hereinafter, referring now to the drawings showing some embodiments of the present invention, the present invention will be described further in detail. However, the present invention is not limited to these embodiments.

Figure 2A:
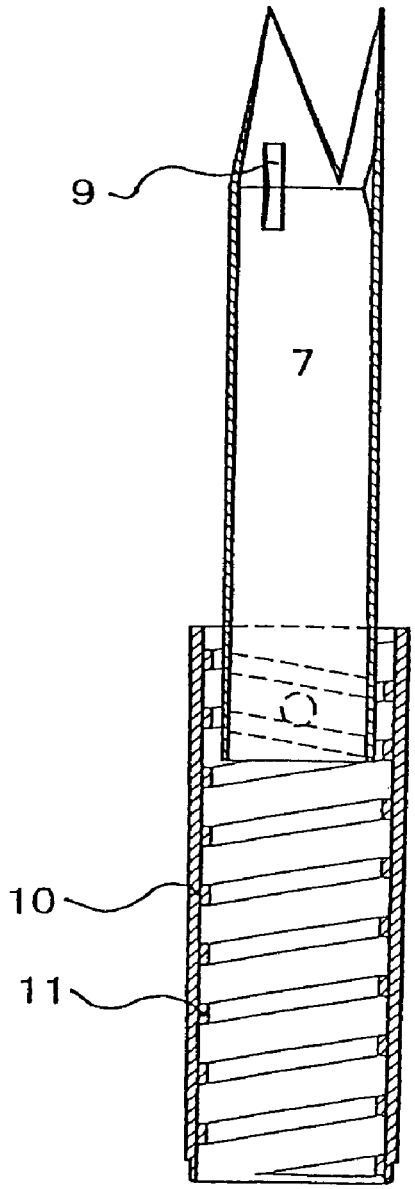
FIG. 2*a* and 2*b* are drawings showing a structure according to an embodiment of a stick-type cosmetic container according to the present invention. An inner container is located at the uppermost position.
Figure 2B:
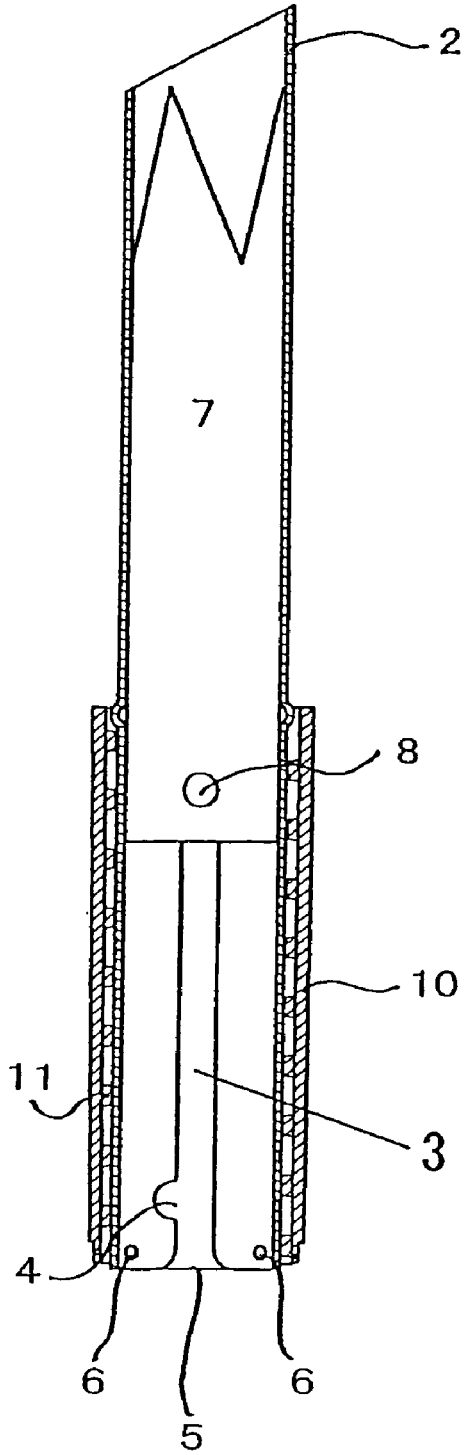

FIG. 2*a* and FIG. 2*b* are drawings showing the structure of an embodiment of a stick-type cosmetic container according to the present invention. FIG. 2*b* is a cross-sectional view substantively showing only an inner container, and FIG. 2*a* is a cross-sectional view showing a state in which only a sleeve is removed (however, the stick-type cosmetic is not shown). In the drawing, reference numeral 1 designates the stick-type cosmetic container, reference numeral 2 designates the sleeve, reference numeral 3 designates an inner container guiding groove, reference numeral 4 designates a small projection storage recess, reference numeral 5 designates a guiding groove end, reference numeral 6 designates an inner container stopper, reference numeral 7 designates an inner container, reference numeral 8 designates a small projection, reference numeral 9 designates a cosmetic holding projection, reference numeral 10 designates an outer cylinder, and reference numeral 11 designates a helical groove, respectively.

Though the stick-type cosmetic container 1 according to the present embodiment basically includes the outer cylinder 10 formed with the helical groove 11 formed on the inner surface thereof, the sleeve 2, and the inner container 7 for accommodating the stick-type cosmetic as in the related art described in conjunction with FIG. 1, it differs in the shape of the sleeve and the fact that the helical groove 11 is formed to the end.

Figure 3:
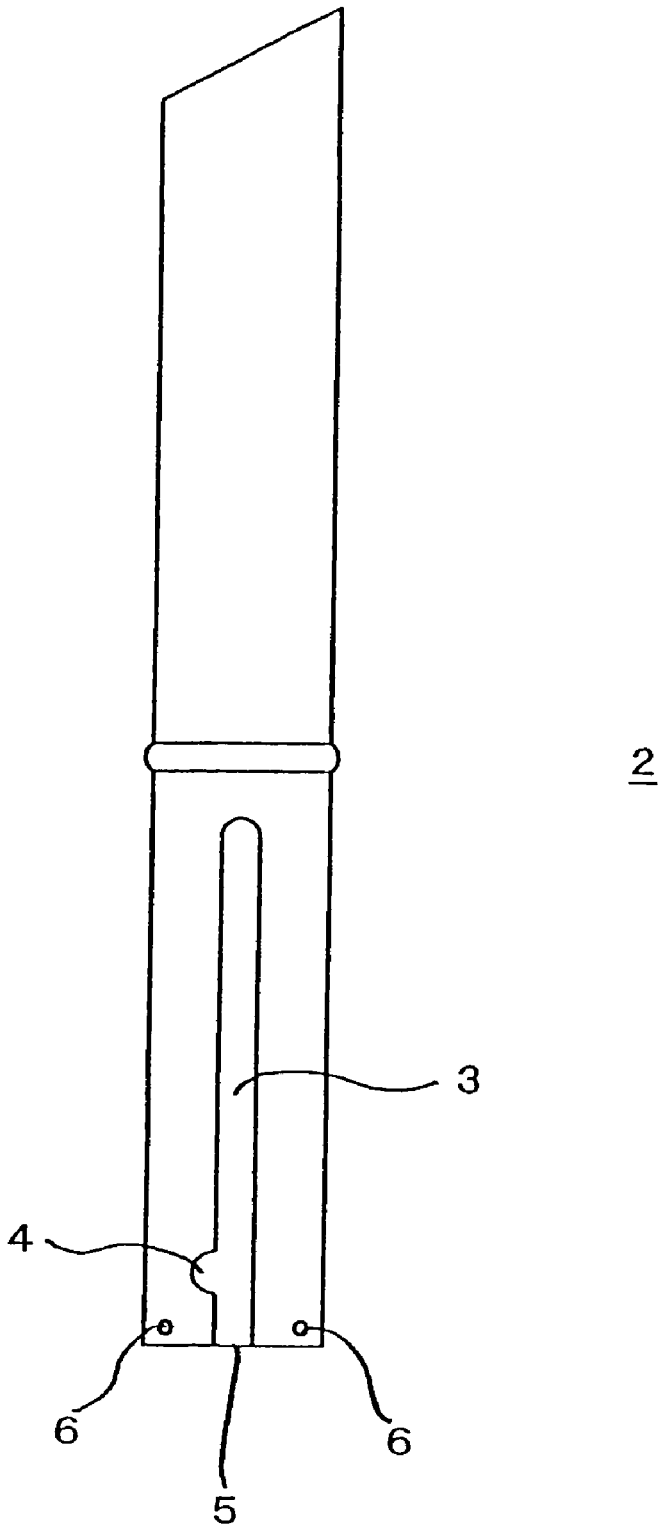
FIG. 3 is a drawing showing a configuration of a sleeve used in the stick-type cosmetic container shown in FIG. 2.

In other words, as seen in the shape of the sleeve 2 used in the present embodiment shown in FIG. 3, it differs from the sleeve used in the stick-type cosmetic container in the related art in that the inner container guiding groove 3 of the sleeve 2 is opened at the lower end 5, in that the small projection storage recess 4 is provided at the lower portion of the inner container guiding groove 3, and in that the inner container stopper 6 is provided at the lower portion of the sleeve 2.

Figure 4:
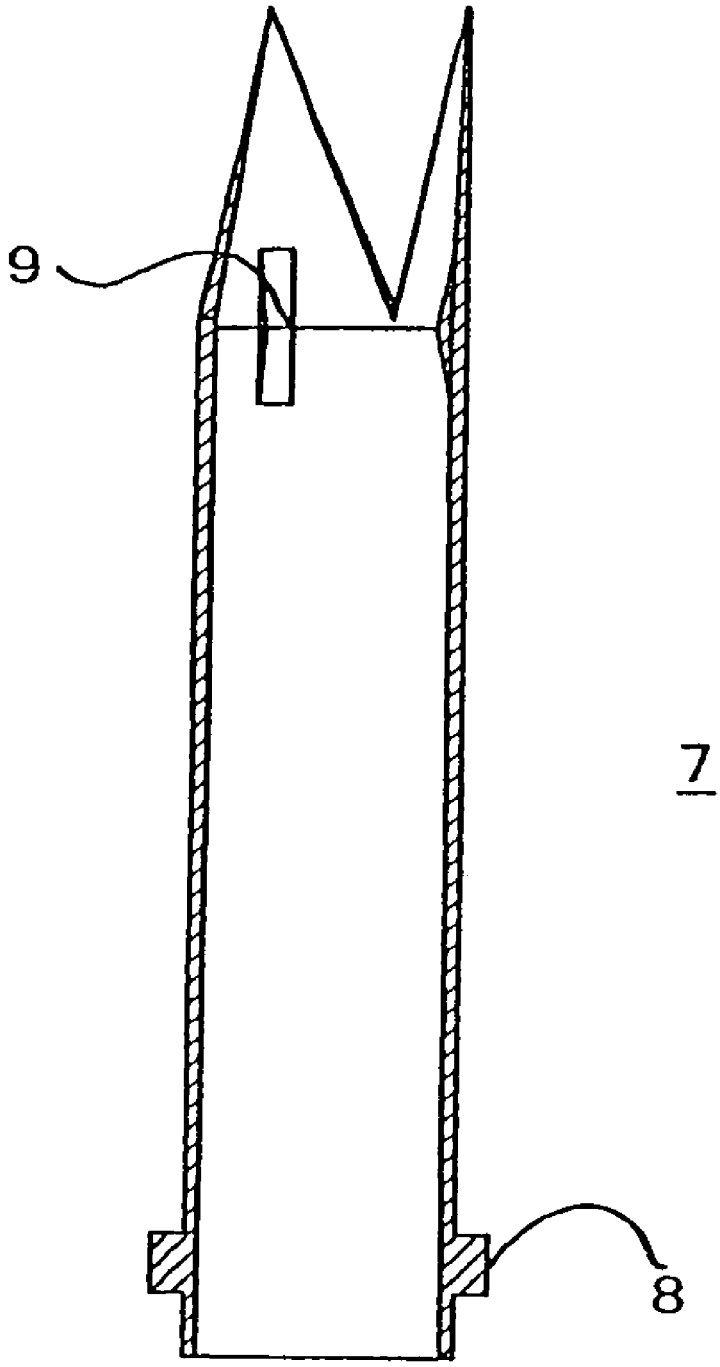
FIG. 4 is a drawing showing the shape of the inner container used in the stick-type cosmetic container shown in FIG. 2.

A cross-section of the inner container 7 used in combination therewith is shown in FIG. 4. The inner container has a cylindrical shape pointed only at the distal end, and includes the cosmetic holding projection 9 at the boundary between the pointed portion and the cylindrical portion for holding the filled stick-type cosmetic in the inner container 7. In addition, at the lower portion of the cylindrical portion, the small projection 8 of small cylindrical shape is provided.

In the stick-type cosmetic container 1 of the present invention, the mechanism in which the inner container 7 does not drop out through the lower portion although the lower end 5 of the inner container guiding groove 3 is opened, and the helical groove 11 of the outer cylinder 10 is formed to the end is as follows.

By rotating the outer cylinder 10 of the stick-type cosmetic container 1 in the state shown in FIG. 2 while holding the sleeve 2 to the left, the helical groove 11 formed on the inside of the outer cylinder 10 provides a force to the small projection of the inner container 7 in the lower left direction. However, since the small projection 8 is guided by the inner container guiding groove 3 of the sleeve 2, it cannot be moved leftward, and thus moves only downward.

Figure 5:
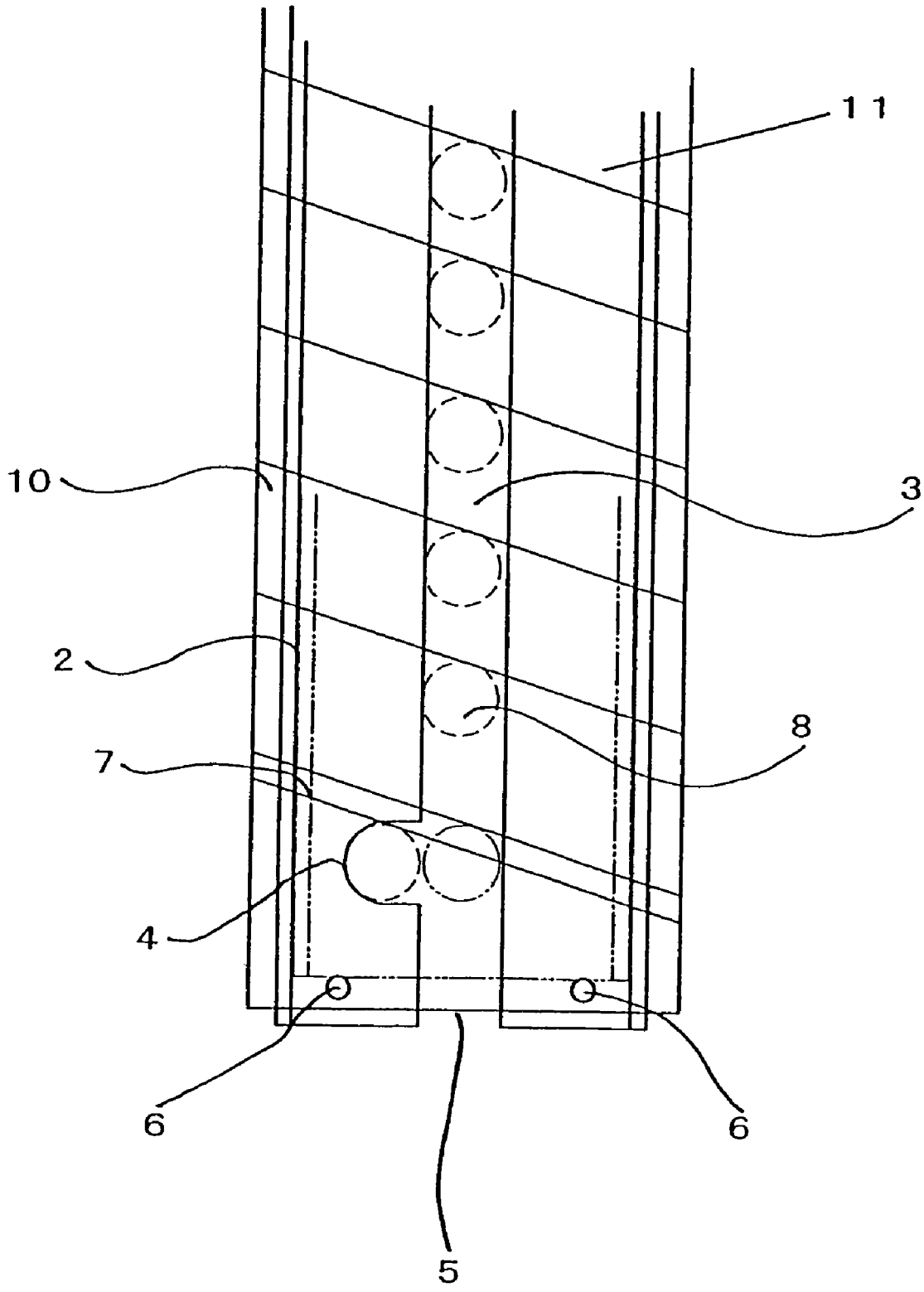
FIG. 5 is a drawing showing the movement of a small projection and the relation between an inner container guiding groove and a small projection storage recess.
Figure 6A:
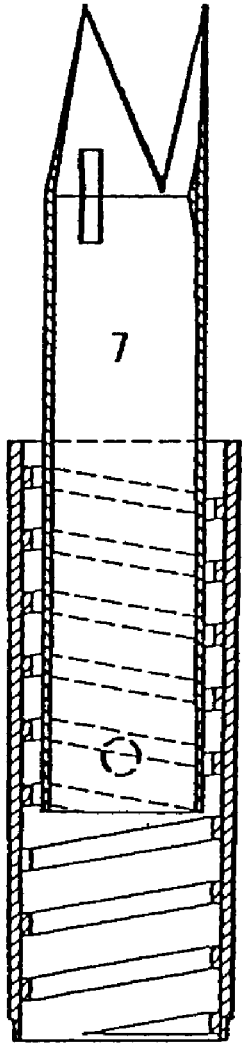
FIGS. 6*a* and 6*b* are drawings showing a state in which the inner container is moved partway downward in the stick-type cosmetic container shown in FIG. 2.
Figure 6B:
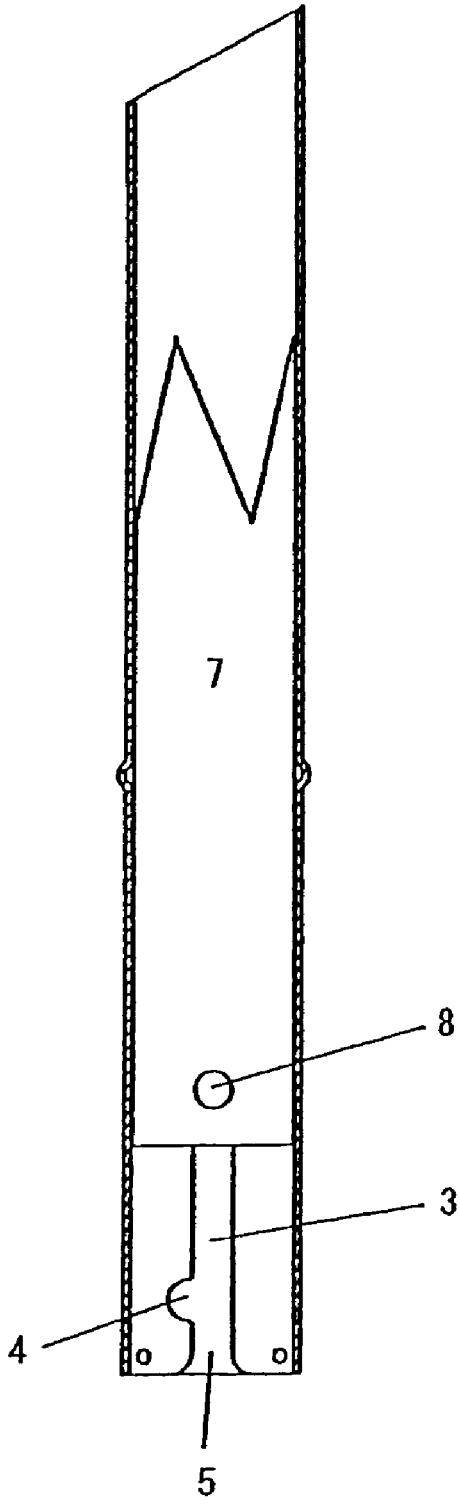

FIG. 5 shows this state of movement. In the drawing, the small projection 8 shown by dotted circles is exerted with a force in the lower left direction by the helical groove 11 shown by the oblique lines. However, since the leftward movement is restrained by the inner container guiding groove 3, it moves downward along the left end of the inner container guiding groove 3. FIG. 6*a* and FIG. 6*b* show the midstage of this movement in the same manner as FIG. 2*a* and FIG. 2*b*, respectively (however, the outer cylinder portion is omitted in FIG. 6*b*).

Figure 7A:
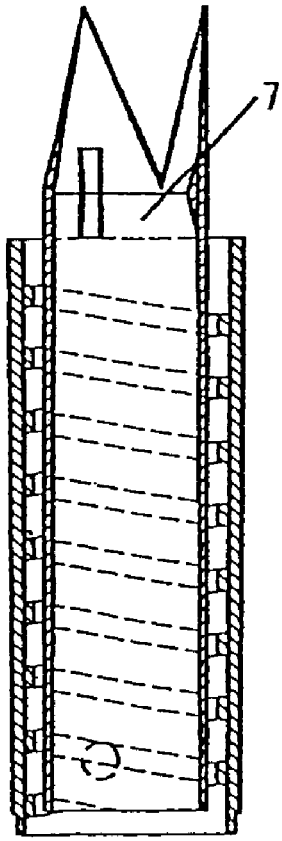
FIGS. 7*a* and 7*b* are drawings showing a state in which the inner container is moved downward and the small projection is stored in the small projection storage recess in the stick-type cosmetic container shown in FIG. 2.
Figure 7B:
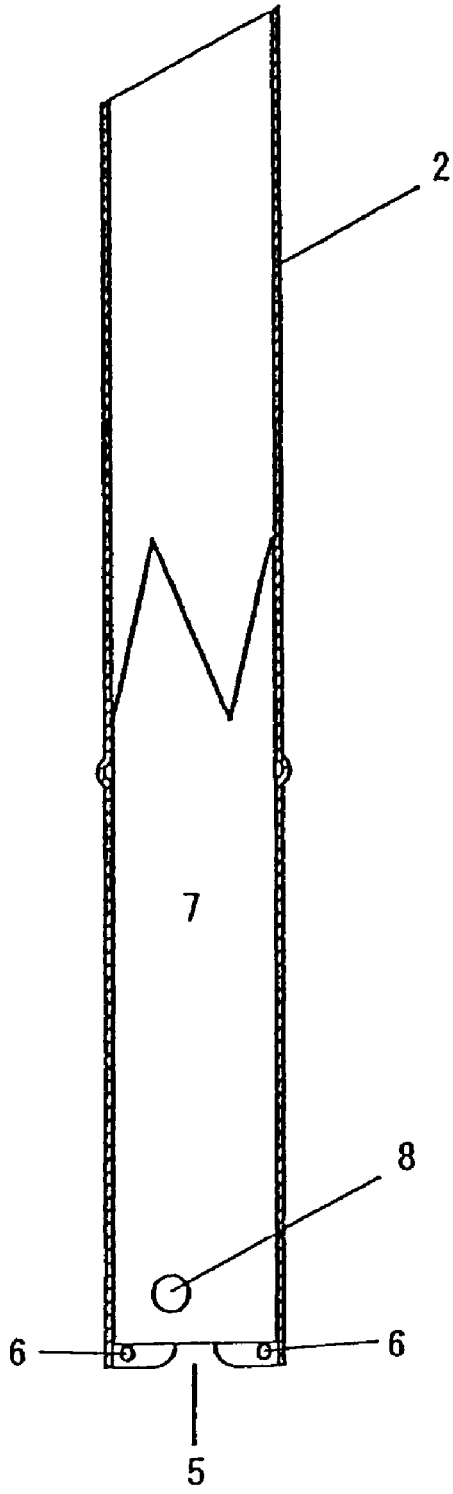

By rotating the outer cylinder leftward in this manner, the small projection 8 is moved downward, and the inner container 7 also moves downward correspondingly. However, since the small projection storage recess 4 is provided at the position near the lower end 5 of the inner container guiding groove 3, a leftward force, which has been restrained by the left end of the inner container guiding groove 3 until that moment, is exerted, and thus the small projection 8 is stored and held in the small projection storage recess 4, not at the position shown by a circle of the chain double-dashed line in FIG. 5. Therefore, since the small projection 8 is restrained in the small projection storage recess 4, it cannot be moved further downward even when an attempt is made to further rotate the outer cylinder 10. FIGS. 7*a* and 7*b* show this state in the same manner as FIG. 2*a* and FIG. 2*b* respectively (however, the outer cylindrical portion is omitted in FIG. 7*b*).

In addition, when the inner container stopper 6 is provided at the lower end of the sleeve 2, it serves as a resistance with respect to the descending inner container 7, and hence the force acting on the small projection 8 exerted from the right side is increased, and thus the small projection 8 can easily enter into the small projection storage recess 4. The inner containers topper 6 may not only be the one which completely stop the inner container 7, but also be the one that generates a resistance to the downward movement when in contact. For example, it can be provided by forming a small projection of a convex shape on the inner side of the lower end of the sleeve 2.

Figure 8:
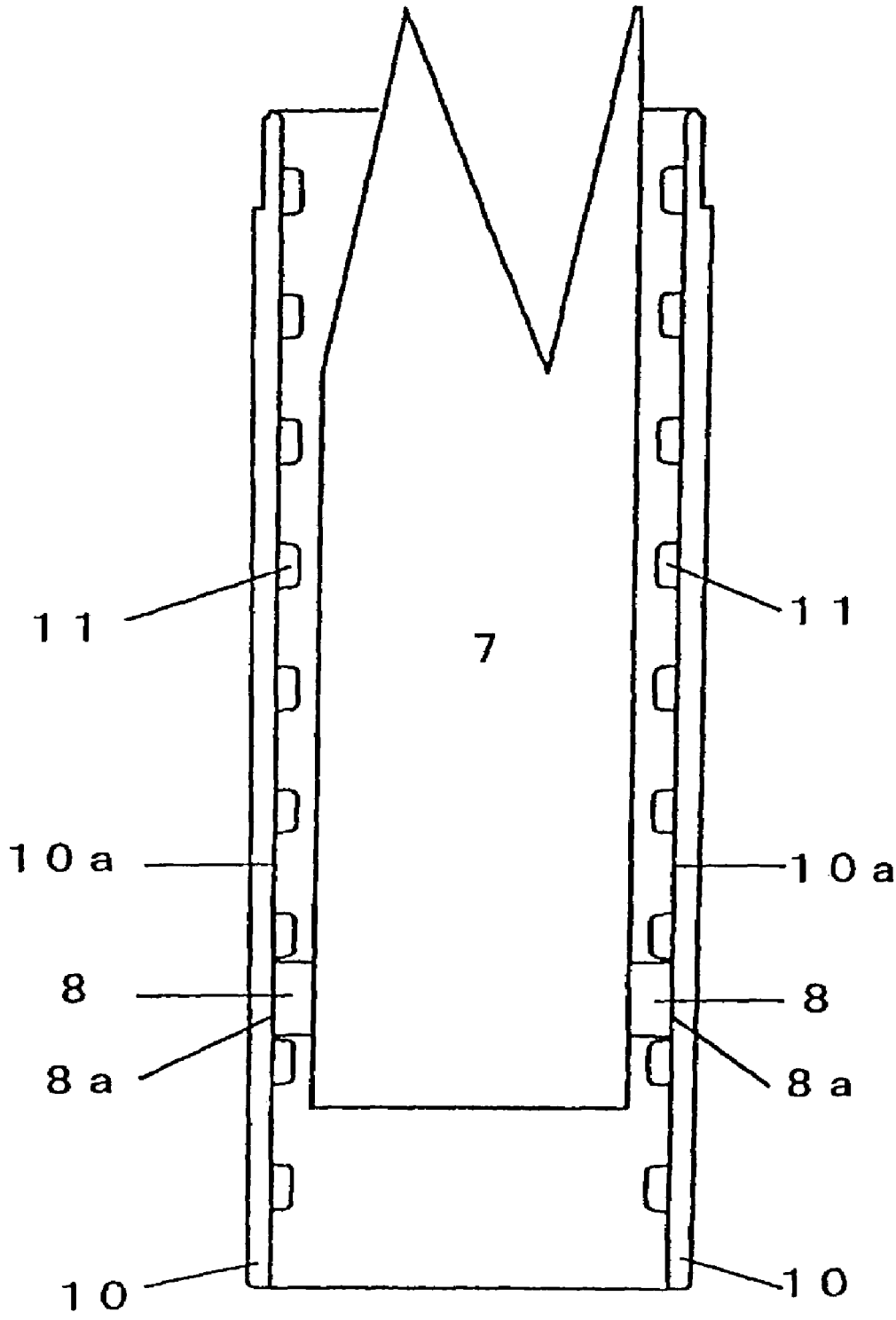
FIG. 8 is a drawing of a stick-type cosmetic container according to the present invention showing a configuration in which the top surface of the small projection provided on the inner container and the inner surface of an outer cylinder come into contact with each other.
Figure 9:
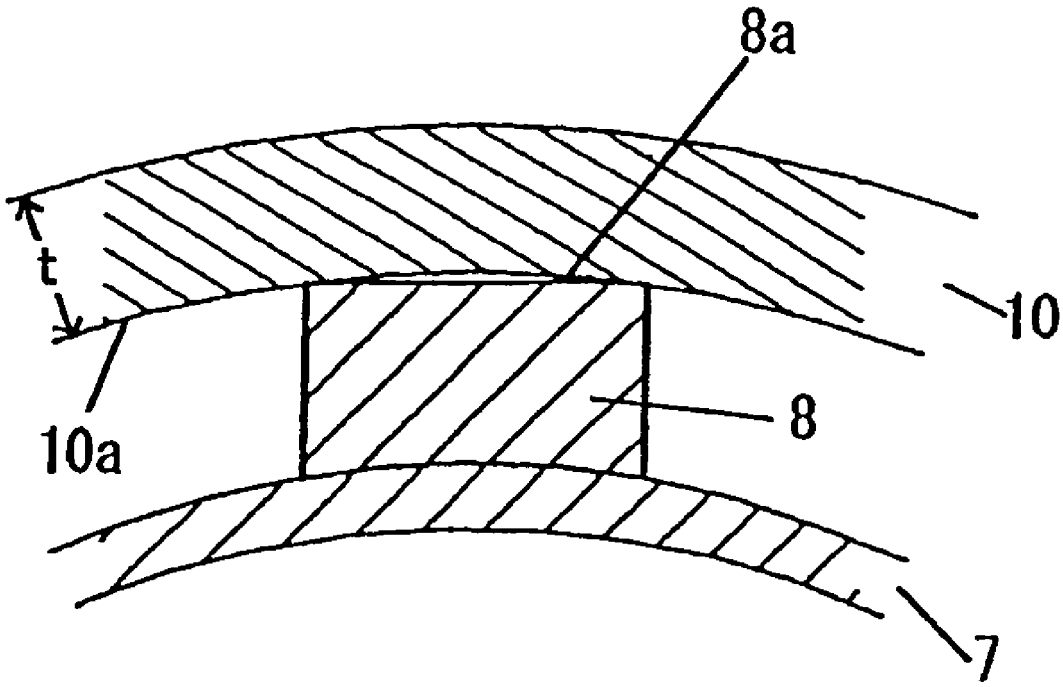
FIG. 9 is a cross-sectional view showing a contact state between the top surface of the small projection and the inner surface of the outer cylinder in FIG. 8.

As another means for allowing easy entrance of the small projection 8 into the small projection storage recess 4, there is a method of bringing at least part of the top surface 8*a* of the small projection 8 and the inner surface 10*a* of the outer cylinder 10 into contact with each other as shown in FIG. 8. According to this method, when the small projection 8 moves upward and downward in the inner container guiding groove 3, at least part of the top surface 8*a* of the small projection 8 and the inner surface 10*a* of the outer cylinder 10 keep constantly in contact with each other and hence a resistance is generated as shown in FIG. 9. Therefore, a force acting on the small projection 8 exerted from the right side is increased and thus it can easily enter into the small projection storage recess 4. When implementing the present embodiment, it is preferable to provide the outer cylinder 10 having the same diameter from the top to the bottom, and in this case, it is preferable to reduce a thickness t of the outer cylinder 10 to provide resiliency. Means for bringing the part of the top surface 8*a* of the small projection 8 into contact with the inner surface 10*a* of the outer cylinder 10 includes a method of setting down the center portion of the top surface 8*a* and allowing only the peripheral portion to come in contact therewith, or a method of providing a rib at the center and allowing only the rib to come into contact therewith.

Subsequently, in order to bring the stick-type cosmetic up from the stick-type cosmetic container 1 in the state shown in FIG. 7 (to move upward), the outer cylinder 10 maybe rotated rightward, in contrast to the means described above. The small projection 8 stored and held in the small projection storage recess 4 receives a force in the upper right direction by the force of the helical groove 11 formed on the outer cylinder 10, and is moved upward along the right end of the inner container guiding groove 3, and then the inner container 7 also moves upward correspondingly.

With this mechanism, the inner container 7 moves upward and downward in the sleeve 2 without dropping out. However, when the stick-type cosmetic filled in the inner container 7 has used up, it can easily be replaced together with the inner container 7 by following means.

In a first place, the inner container 7 is moved to the lowermost position, and the small projection 8 is stored in the small projection storage recess 4. Then, by suitable means such as the usage of a jig, the small projection 8 on the inner container 7 is moved from the small projection storage recess 4 to the position shown by the circle of the double-dashed line in FIG. 5. When it is moved to this position, since the lower end 5 of the inner container guiding groove 3 is opened, and thus the spent stick-type cosmetic can easily be taken out together with the inner container 7 by surmounting the resistance of the inner container stopper 6 by the operation of the jig.

Subsequently, replacement of the stick-type cosmetic is completed by inserting a new stick-type cosmetic filled in the inner container from the bottom of the stick-type cosmetic container 1 and storing the small projection 8 into the small projection storage recess 4 by the use of the jig again.

In the stick-type cosmetic container 1 of the present invention, it is possible to fill the stick-type cosmetic in the inner container 7 in advance and mounting it in the container 1. However, it is also possible to mount the inner container 7 without having the stick-type cosmetic filled therein into the stick-type cosmetic container 1 and then filling the cosmetic in the melted state from the bottom of the cosmetic container 1 into the sleeve 2 or the inner container 7 to a predetermined level and making it solid by cooling or the like to prepare the stick-type cosmetic.

Figure 10:
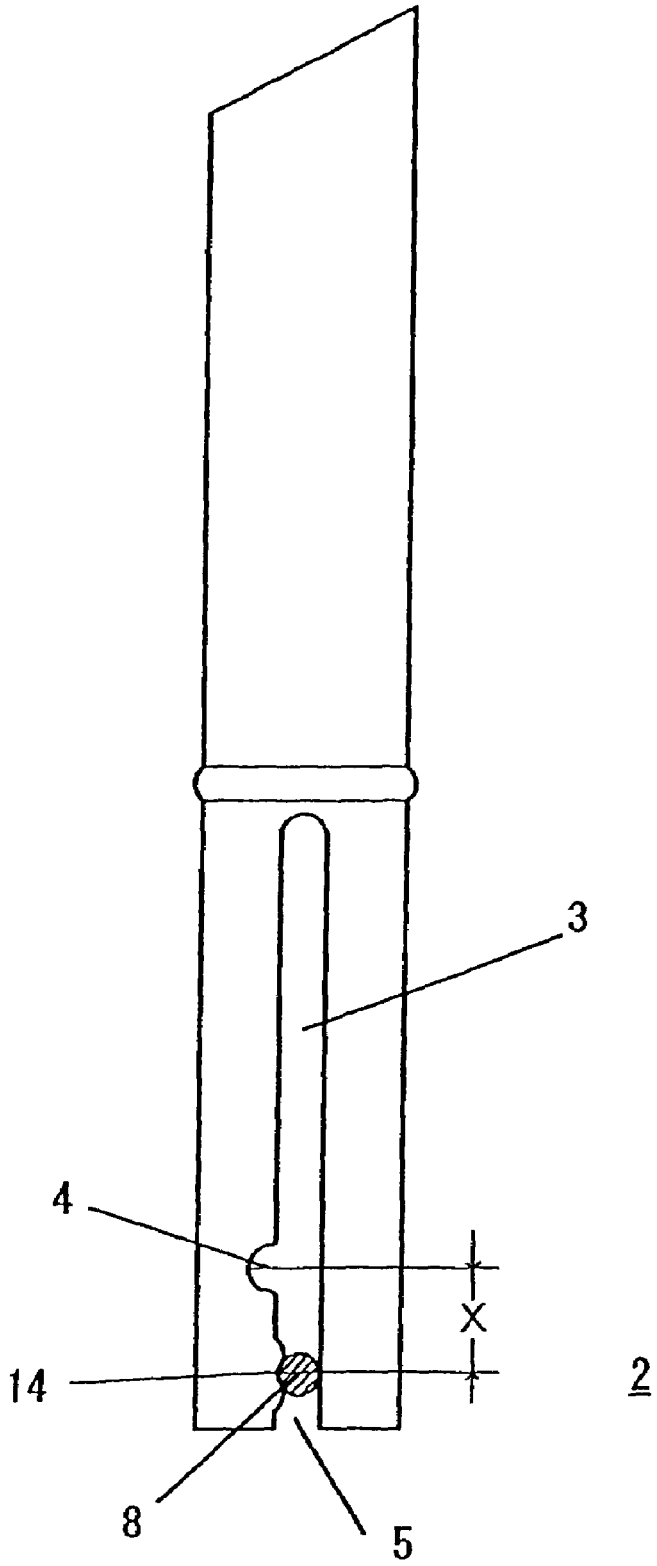
FIG. 10 is a drawing showing a configuration in which a stop point is provided on the sleeve which constitutes the present invention.

The shape of the sleeve 2 of the stick-type cosmetic container 1 suitable for the preparing method of the latter is shown in FIG. 10.

Figure 11:
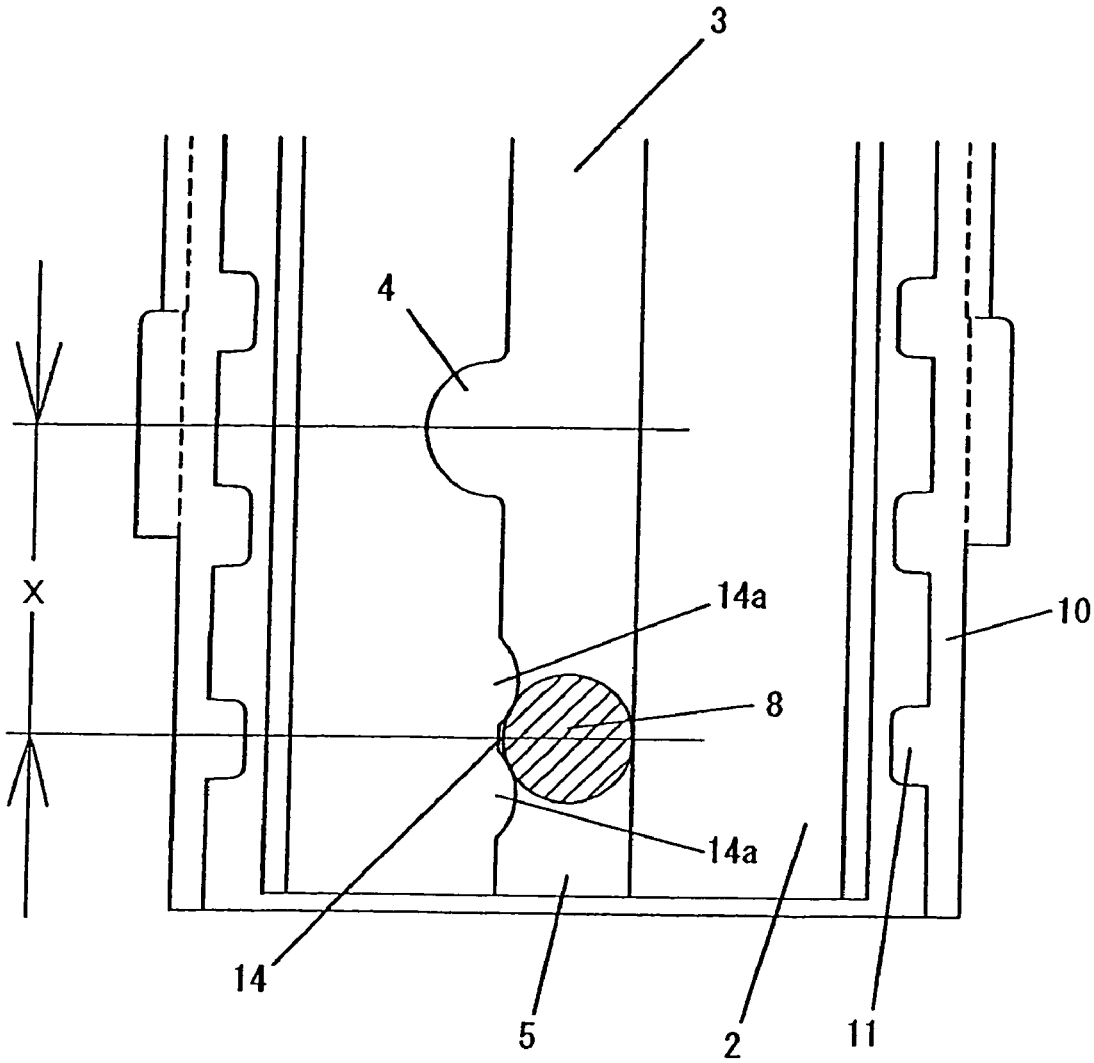
FIG. 11 is a partly enlarged drawing showing the positional relation between the small projection storage recess and the stop point in a state in which the stop point is provided on the sleeve.

The sleeve 2 shown in FIG. 10 further includes a stop point 14 at the lower portion of the small projection storage recess 4 formed on the inner container guiding groove 3 (In this embodiment, the small projection 8 is placed at the position marked with a hatched circle in the drawing when being filled). FIG. 11 is a partial enlarged drawing showing the positional relation between the small projection storage recess 4 and the stop point 14 in the present embodiment. In the present embodiment, two small projections 14*a* are provided continuously at the lower portion of the small projection storage recess 4 in the inner container guiding groove 3, and the portion interposed between the projections 14*a* is used as the stop point 14. Reference sign "X" designates the distance between the center of the small projection storage recess 4 and the center of the stop point 14.

Figure 12:
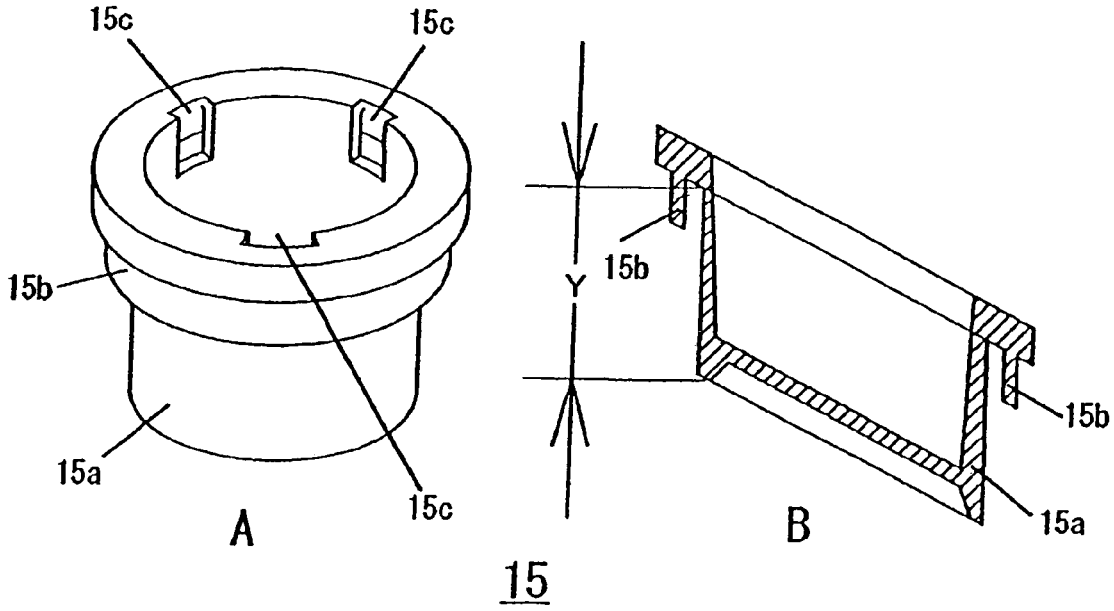
FIG. 12 is a drawing showing an embodiment of a sealing device.

The sleeve 2 is used with sealing device 15 shown in FIG. 12, which is to be mounted to the opening thereof, and is capable of bringing the distal end of the sleeve and the distal end surface of the stick-type cosmetic flush with each other.

In other words, in preparing the stick-type cosmetic, when the cosmetic was filled using the normal cover, there arose the problem in that the cosmetic leaks from the gap of the cover, and attached to the edge of the opening, which lowered the commercial value.

Such drawback can be resolved by filling the cosmetic so as not to reach the opening of the sleeve, that is, by using a cap which is set back inwardly. However, when the stick-type cosmetic is not filled up to the level of the opening of the sleeve when starting to use, the consumer may think that the filling amount is not sufficient, which is not commercially desirable as a commodity design.

In order to cope with such problems, the stop point 14 which is capable of fixing the small projection 8 temporarily is provided on the inner container guide groove 3 of the sleeve 2 downwardly of the small projection storage recess 4, and the sealing device 15 is mounted to the opening of the sleeve 2 when filling and molding the cosmetic. In addition, it was found that the positional relation between the distal end of the sleeve and the distal end surface of the cosmetic can be controlled freely and aligned by providing inward setbacks on the sealing device 15 corresponding to the interval between the small projection storage recess 4 and the stop point 14.

FIG. 12 is an embodiment of the sealing device used for the above-described object, in which A is a perspective view and B is a cross-sectional view. In the drawings, reference numeral 15*a* designates an insertion portion, reference numeral 15*b* designates a fitting portion, and reference numeral 15*c* designates an air hole.

Figure 13:
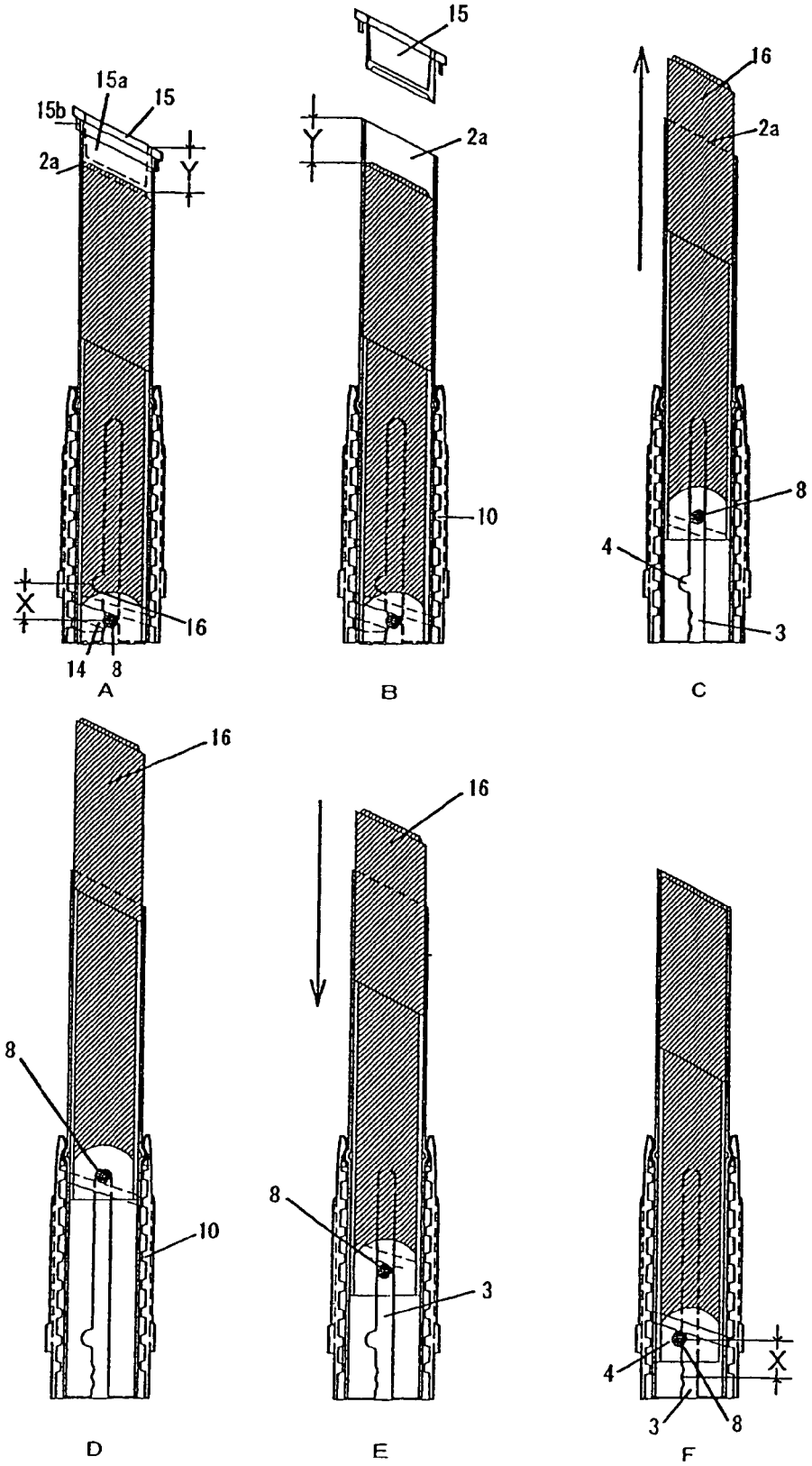
FIG. 13 is a drawing showing an example of a flow of using a stick-type cosmetic container 1 of the present invention, filling cosmetic into the stick-type cosmetic container 1, and then conducting a test by bringing the stick-type cosmetic outwardly of the container, and returning the cosmetic again into the container.

FIG. 13 shows an example of flow including the steps of filling the cosmetic in the stick-type cosmetic container 1 using the sleeve 2 shown in FIG. 10 and FIG. 11 and the stick-type cosmetic container 1 including the sealing device 15 shown in FIG. 12 to prepare the stick-type cosmetic, inspecting the stick-type cosmetic by bringing it up, and returning the cosmetic into the cosmetic container 1.

In other words, the sealing device 15 is placed on an opening 2*a* of the sleeve in a state with the small projection 8 (black portion in FIG. 13) stored in the stop point 14, and the opening 2*a* of the sleeve is clamped between the insertion portion 15*a* and the fitting portion 15*b* of the sealing device 15 for fixing and sealing. Subsequently, by inverting the cosmetic container 1 so as to be upside down, and filling the stick-type cosmetic in the melted state from the bottom thereof, the cosmetic can be filled in the hatched portion, and may be cooled and solidified so that the stick-type cosmetic 16 is formed and prepared (A in FIG. 13).

When the sealing device 15 is removed from the opening 2*a* of the sleeve after filling and molding of the cosmetic, the stick-type cosmetic 16 is obtained in a state in which the portion of the sleeve on the distal end side is not filled with the cosmetic by the length Y (See the drawing B). Then when the outer cylinder 10 is rotated rightward, the small projection 8 moves away from the stop point 14 and moves along the right end of the inner container guiding groove 3 upward without being stored in the small projection storage recess 4 positioned on the left side of the guiding groove 3. At this time, the stick-type cosmetic 16 moves away from the surface of the sleeve 2, moves upward in the state of being fixed to the inner container 7, and is brought up from the sleeve opening 2*a*. (See the drawing C. An arrow indicates the direction in which the stick-type cosmetic 16 advances. It is the same in the drawing E).

The stick-type cosmetic 16 is inspected in the state of being bought up to the maximum (See the drawing D). After the inspection, by rotating the outer cylinder 10 toward the left, the small projection 8 moves downward along the left end of the inner container guiding groove 3, and the stick-type cosmetic 16 also moved downward according to the movement of the inner container 7 (See the drawing E). Then, the small projection 8 is finally stored and held in the small projection storage recess 4 provided at the lower left of the guiding groove 3 (See the drawing F).

In this manner, according to the present embodiment, the position of the small projection 8 (at the stop point 14) when starting the filling operation differs from the position of the small projection 8 (in the small projection storage recess 4) at the time of shipping. In this case, by setting the distance X between the stop point 14 and the small projection storage recess 4 to meet the length of the sealing device 15 (that is, the unfilled portion Y at the distal end), the distal end surface of the stick-type cosmetic 16 and the opening 2*a* of the sleeve preferably coincide with each other when the small projection 8 is stored in the small projection storage recess 4. In addition, since the sealing device 15 which is set back inwardly is used, the cosmetic does not leak from the edge of the sleeve opening 2*a* when filling the cosmetic, and hence the problem of stain at the opening 2*a* may be avoided.

The shape of the stop point 14 in the present embodiment is not limited as long as it can stop the small projection 8 when filling the cosmetic. However, the shape which fixes the small projection 8 and, simultaneously, allows it to move easily when moving upward along the right end of the inner container guiding groove 3 is preferable. With such shape, when bringing up the stick-type cosmetic 16 (moving the small projection 8 upward) by rotating the outer cylinder 10 rightward after filling and molding the cosmetic, the small projection 8 is subjected to the force in the right upward direction, so that the stick-type cosmetic 16 does not rotate by itself when being brought up, and the upward movement along the right end of the inner container guiding groove 3 is done smoothly.

Another reason why the embodiment described above is preferable is as follows. Since the cosmetic filled in the stick-type cosmetic container 1 slightly shrinks when being cooled and solidified, the outer surface of the cosmetic normally comes away from the inner surface of the sleeve. However, the cosmetic and the sleeve may stay in tight contact on rare occasion. In such a state, when a rotational force is exerted to the cosmetic in order to bring up the stick-type cosmetic by rotating the outer cylinder 10 rightward, the cosmetic may disadvantageously be broken since the sleeve 2 and the cosmetic are in tight contact with each other. On the other hand, by employing the stop point 14 in the configuration as described above, the small projection 8 received only the upward force, and thus the cosmetic can be peeled off the inner surface of the sleeve without rotating the stick-type cosmetic when being brought up.

The stop point 14 is preferably formed by machining the lower portion of the small projection storage recess 4 in the inner container guiding groove 3 into the configuration shown in FIG. 10 and FIG. 11 as described in the embodiment described above. Though not shown, it is also possible to form the lower end of the small projection storage recess 4 so as to overhang into the inner container guiding groove 3. In this configuration as well, the small projection 8 can easily be moved along the right end of the inner container guiding groove 3.

The shape of the sealing device 15 in the present embodiment is not specifically limited as long as it can close the opening of the sleeve 2. However, the length Y preferably coincides with the distance X between the small projection storage recess 4 and the stop point 14. In addition, like the configuration shown in FIG. 12, by forming the suitable air hole 15*c* for allowing air ventilation, air can easily be flown into the gap between the inner surface of the sleeve 2 and the cosmetic when the cosmetic shrinks in response to cooling at the time of filling and molding, and hence peeling off of the cosmetic is preferably performed smoothly. In addition, it is further preferable to employ a capsule-shape, since it can be removed easily.

Though the number of the air hole 15*c* is not specifically limited, forming three or four air holes 15*c* is preferable in view of usability and manufacturability of the sealing device 15.

The position of the small projection 8 at the stop point 14 shown in FIG. 11 is slightly displaced in the direction of rotation from the position of the small projection storage recess 4 when the stick-type cosmetic is stored. This configuration has no problem as long as the shape of the distal end of the stick-type cosmetic is rotational symmetry with respect to the centerline of the stick-type cosmetic. However, in the case where the distal end is inclined as shown in FIG. 10, the direction of the end surface of the opening of the sleeve 2 and the direction of the end surface of the stick-type cosmetic when the stick-type container is stored do not coincide due to the above-described displacement in the direction of rotation, which may result in rough finish. In such case (in the configuration shown in FIG. 10), it is preferable to correct the shape of the sealing device 15 to the extent corresponding to such displacement in advance so that both of the surfaces coincide with each other.

Figure 14:
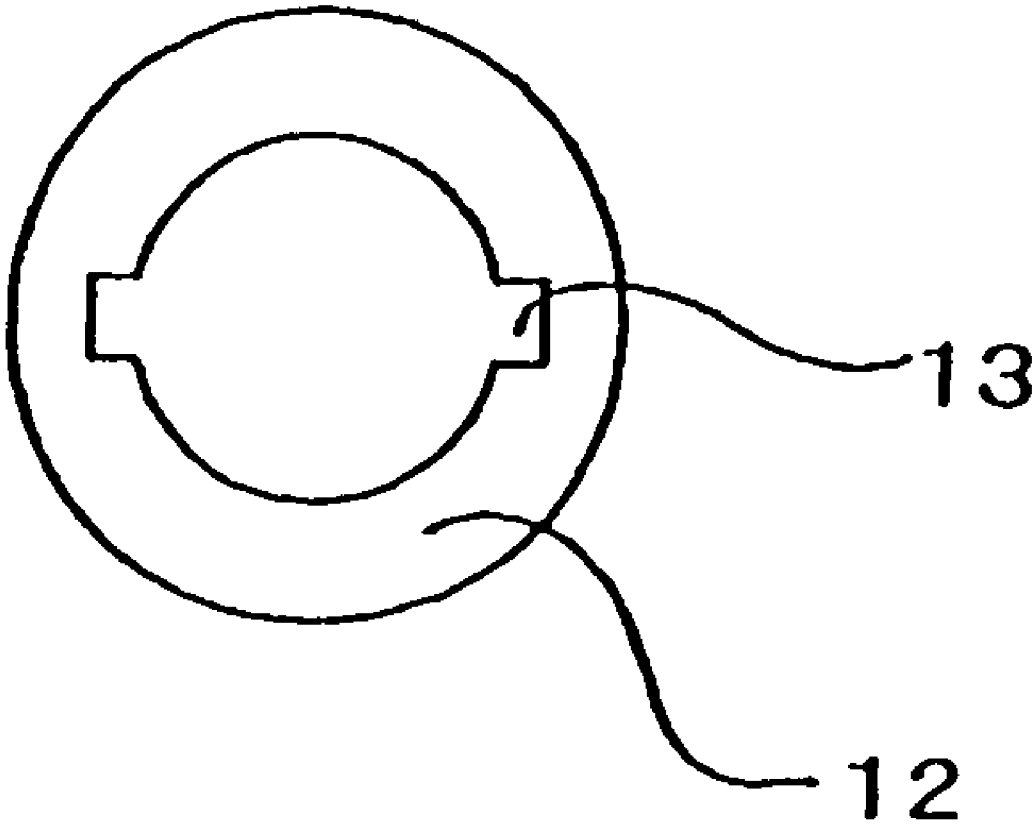
FIG. 14 is a drawing showing an example of the shape of the bottom.

In the stick-type cosmetic container 1 of the present invention, since there are cases in which the stick-type cosmetic is taken in and out from the bottom, it is necessary that the bottom is opened to some extent. However, since such state does not present good appearance, the bottom 12 may be formed, for example, into the shape shown in FIG. 14, and adhered with a sticker in normal use. The size of the hole on the bottom 12 may be slightly larger than the inner container 7, and a notch 13 may be formed so as to correspond to the small projection 8.

It will be convenient to mark the product number, the color tone, and the like on the sticker to be adhered on the bottom 12 when purchasing the stick-type cosmetic for replacement.

Figure 15:
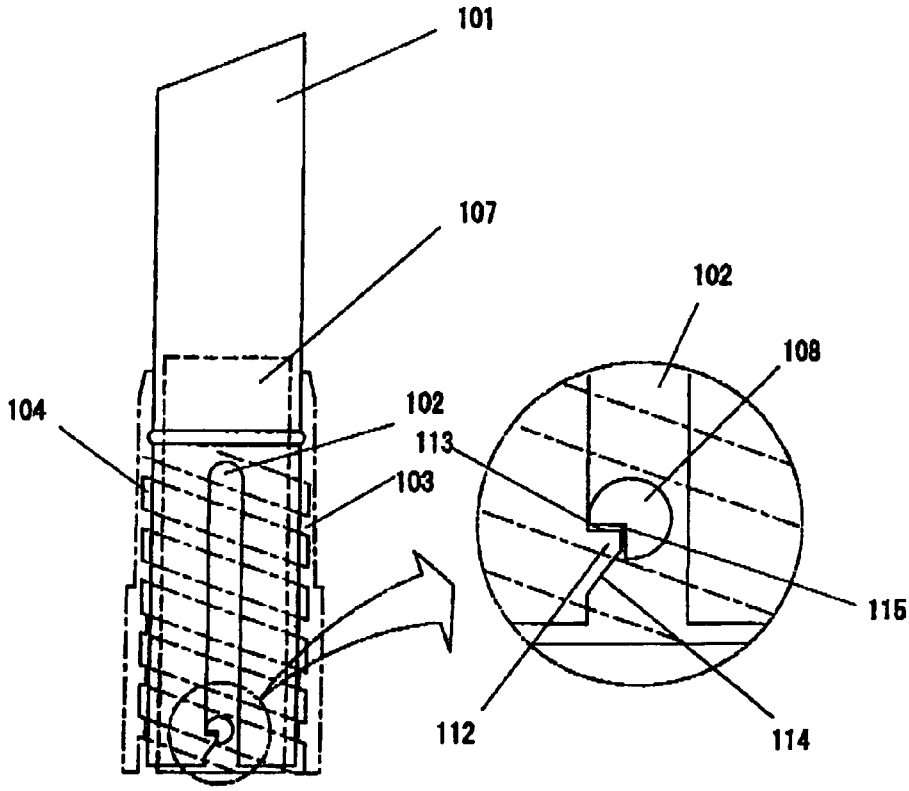
FIG. 15 is a drawing showing the structure of another embodiment of the stick-type cosmetic container of the present invention. The inner container is located at the lowermost position.
Figure 16:
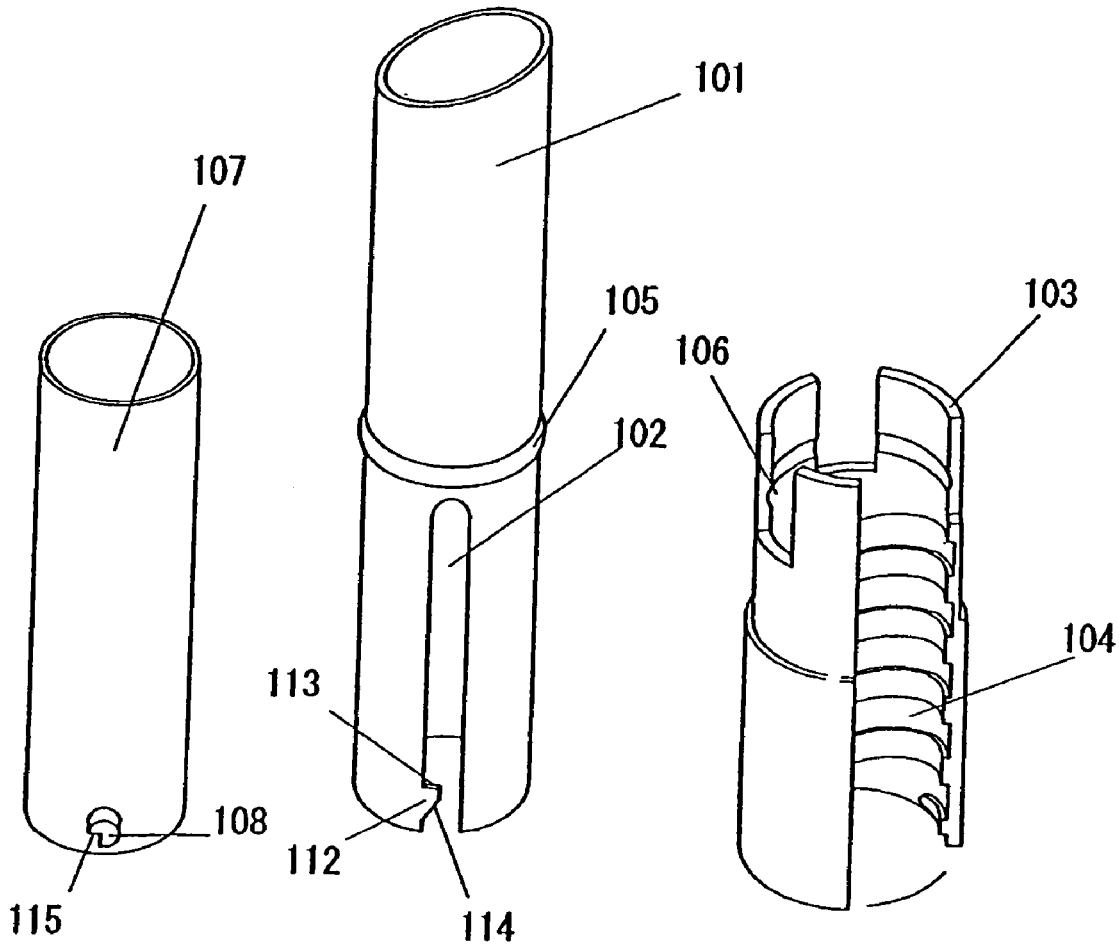
FIG. 16 is a drawing showing the shapes of the sleeve, the inner container, and the outer cylinder used in the stick-type cosmetic container shown in FIG. 15.

Another configuration of the small projection retaining mechanism of the stick-type cosmetic container of the invention is shown in FIG. 15 to FIG. 16. In the drawings, reference numeral 101 designates a sleeve, reference numeral 102 designates an inner container guiding groove, reference numeral 103 designates an outer cylinder, reference numeral 104 designates a helical groove, reference numeral 105 designates an annular projection, reference numeral 106 designates a recess groove, reference numeral 107 designates an inner container, reference 108 designates a small projection, reference numeral 112 designates a locking projection, reference numeral 113 designates a locking surface, reference numeral 114 designates a gentle slope, and reference numeral 115 designates a locking notch.

In this configuration, the retaining mechanism including the locking projection 112 formed at the lower portion of the inner container guiding groove 102 and the locking notch 115 formed at the position corresponding to the locking projection 112 of the small projection 108 is provided.

The locking projection 112 is formed to make the width of the inner container guiding groove 102 smaller than the diameter of the small projection 108 on the inner container 107, and is formed on the side surface toward which the small projection 108 is pushed against by the helical groove 104 when the inner container 107 is moved downward (the left side in FIG. 15). The upper surface of the locking projection 112 is formed with a substantially horizontal locking surface 113 so as to fit to the locking notch 115 of the small projection 108. Since a force to push the small projection 108 toward the left is generated when the small projection 108 is moved downward, the small projection 108 cannot climb over the locking projection 112, and hence the inner container 107 is prevented from dropping out of the sleeve 101.

Figure 17:
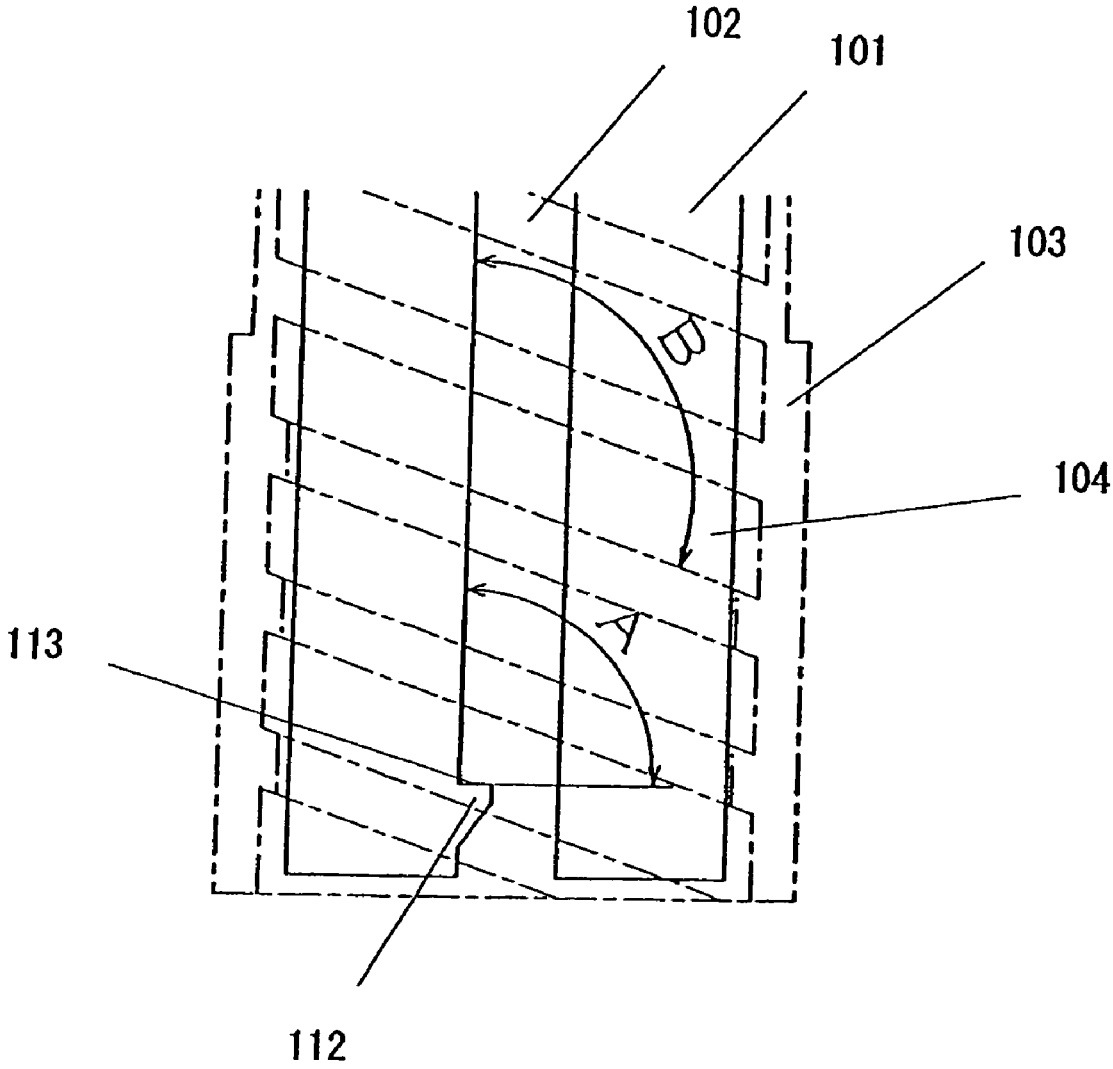
FIG. 17 is a drawing showing the relation between the angle of a helical groove and the angle of a locking surface in the embodiment shown in FIG. 15.

It is necessary to define the angle formed between the locking surface 113 and the upper portion of the inner container guiding groove 102 (angle A in the drawing) smaller than the angle formed between the helical groove 104 and the upper portion of the inner container guide groove 102 (angle B in the drawing) as shown in FIG. 17. The lower surface 114 of the locking projection 112 is preferably a gentle slope so that the small projection 108 can easily climb over the locking projection 112 by broadening the width of the inner container guiding groove 102 when setting the inner container 107 to the sleeve 101.

In the stick-type cosmetic according to the present invention, it is necessary to allow the sleeve 101 and the outer cylinder 103 to rotate freely but keep them not to be dropped out easily. In order to do so, for example, a mechanism in which the annular projection 105 formed into a ring-shape at the substantially center of the sleeve 101 is clamped in the recess groove 106 formed on top of the outer cylinder 103 as shown in FIG. 16 may be provided.

Figure 18:
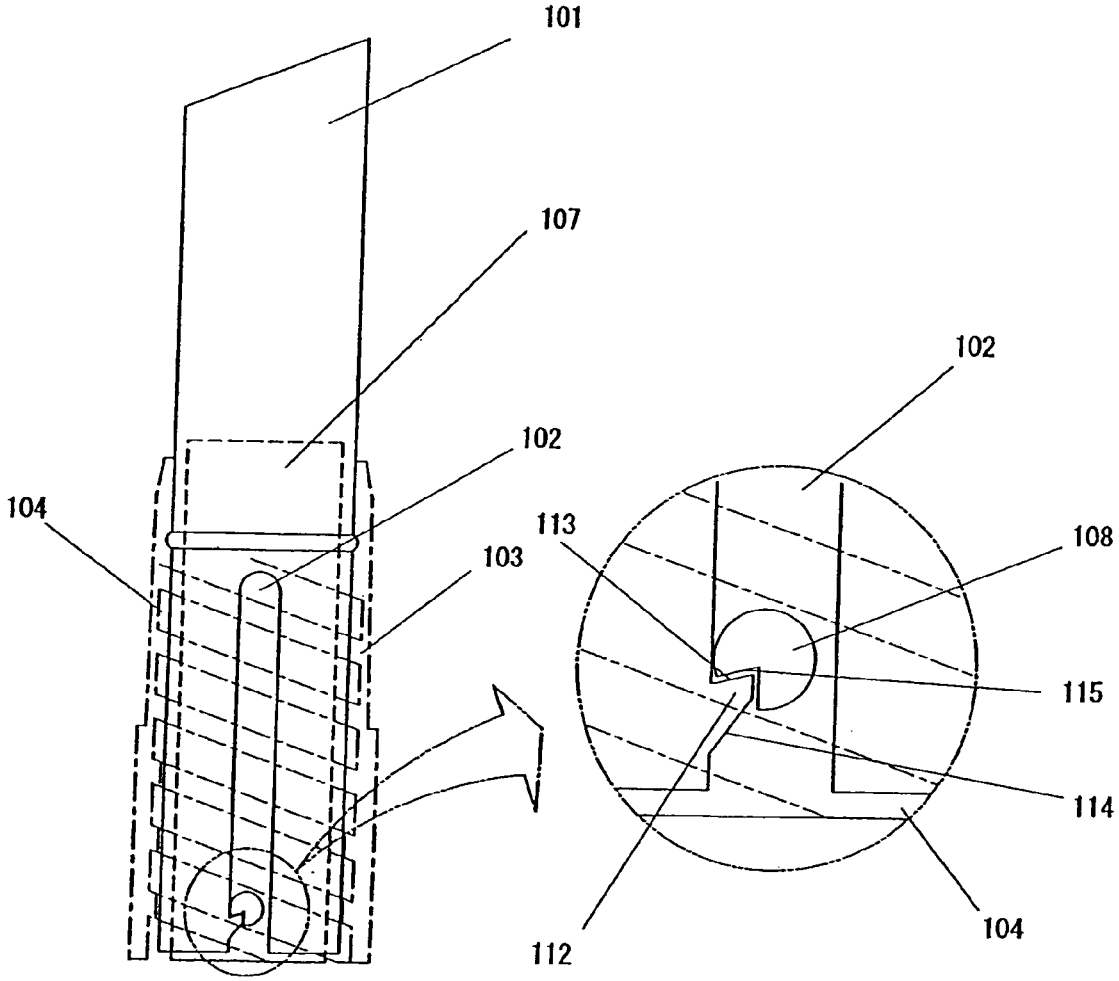
FIG. 18 is a drawing showing a configuration in which the distal end of locking surface is moved upward (the state in which the angle formed between the guiding groove and the locking surface is an acute angle).

Though the small projection 108 in this configuration is not specifically limited, it is preferable to form it into a small column in order to ensure fitting between the locking notch 115 and the locking projection 112. Alternatively, as shown in FIG. 18, the distal end of the locking surface 113 may be raised in order to enhance the effect of holding the small projection 108.

In the retaining mechanism described above, it is also possible to provide a plurality of either small projections 108 or locking notches 115 to provide a plurality of holding positions.

Figure 19:
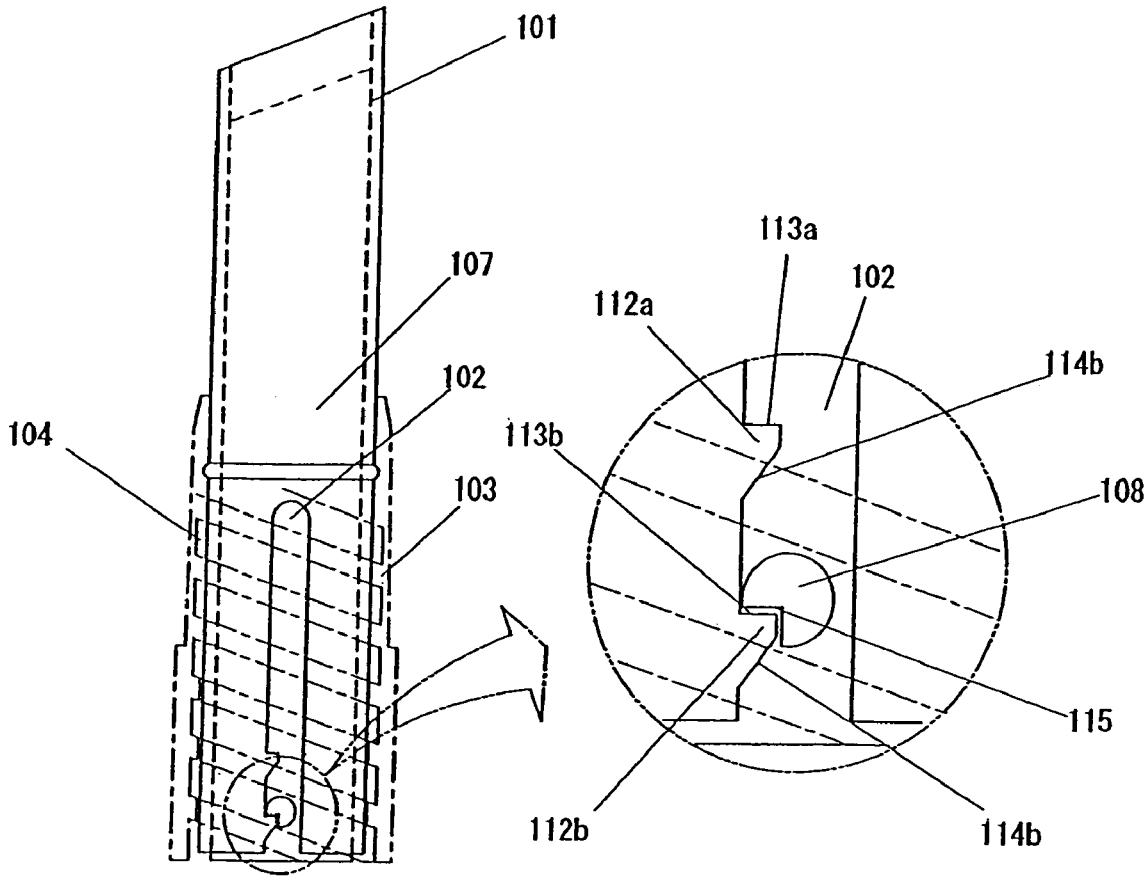
FIG. 19 is a drawing showing the structure of an embodiment in which the locking projections are provided at two levels. The inner container is located at the lowermost position.
Figure 20:
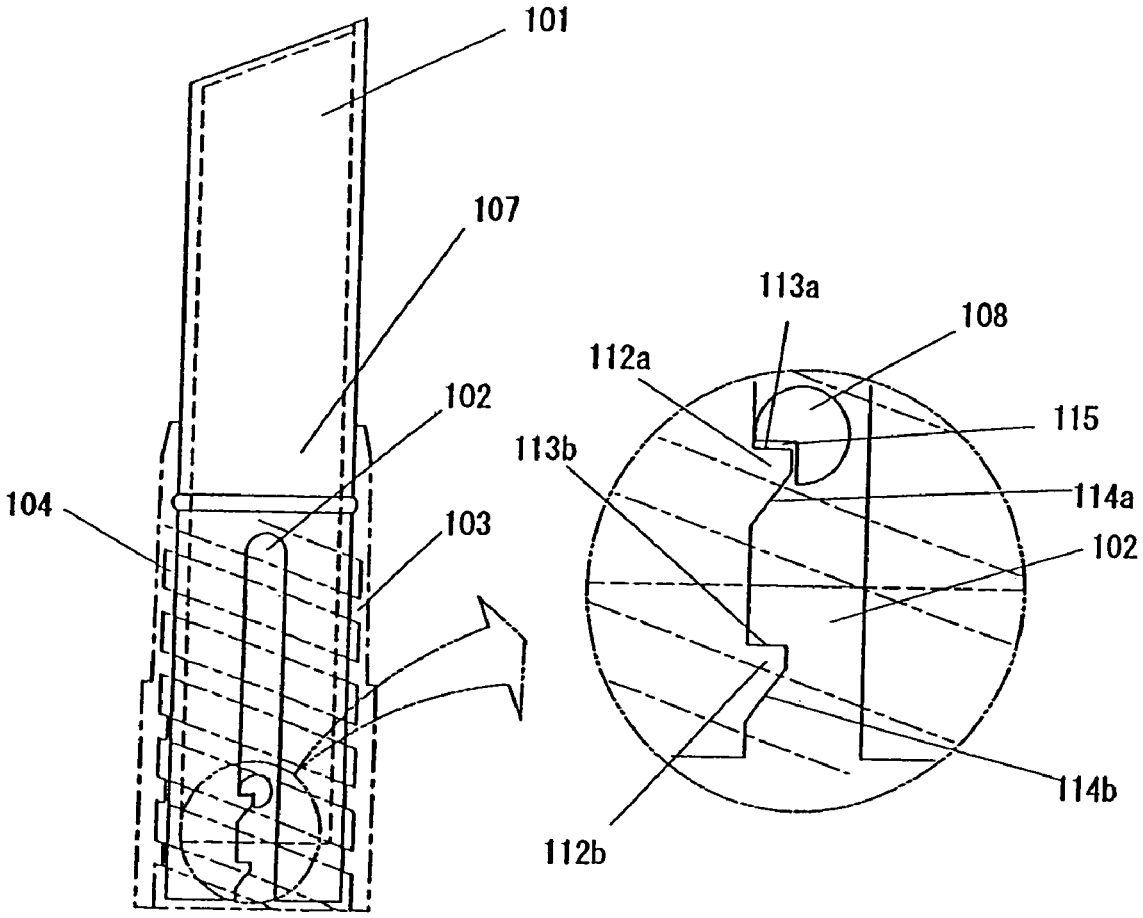
FIG. 20 is a drawing showing a state in which the inner container is at the lowermost position in normal use in the embodiment shown in FIG. 19.
Figure 21:
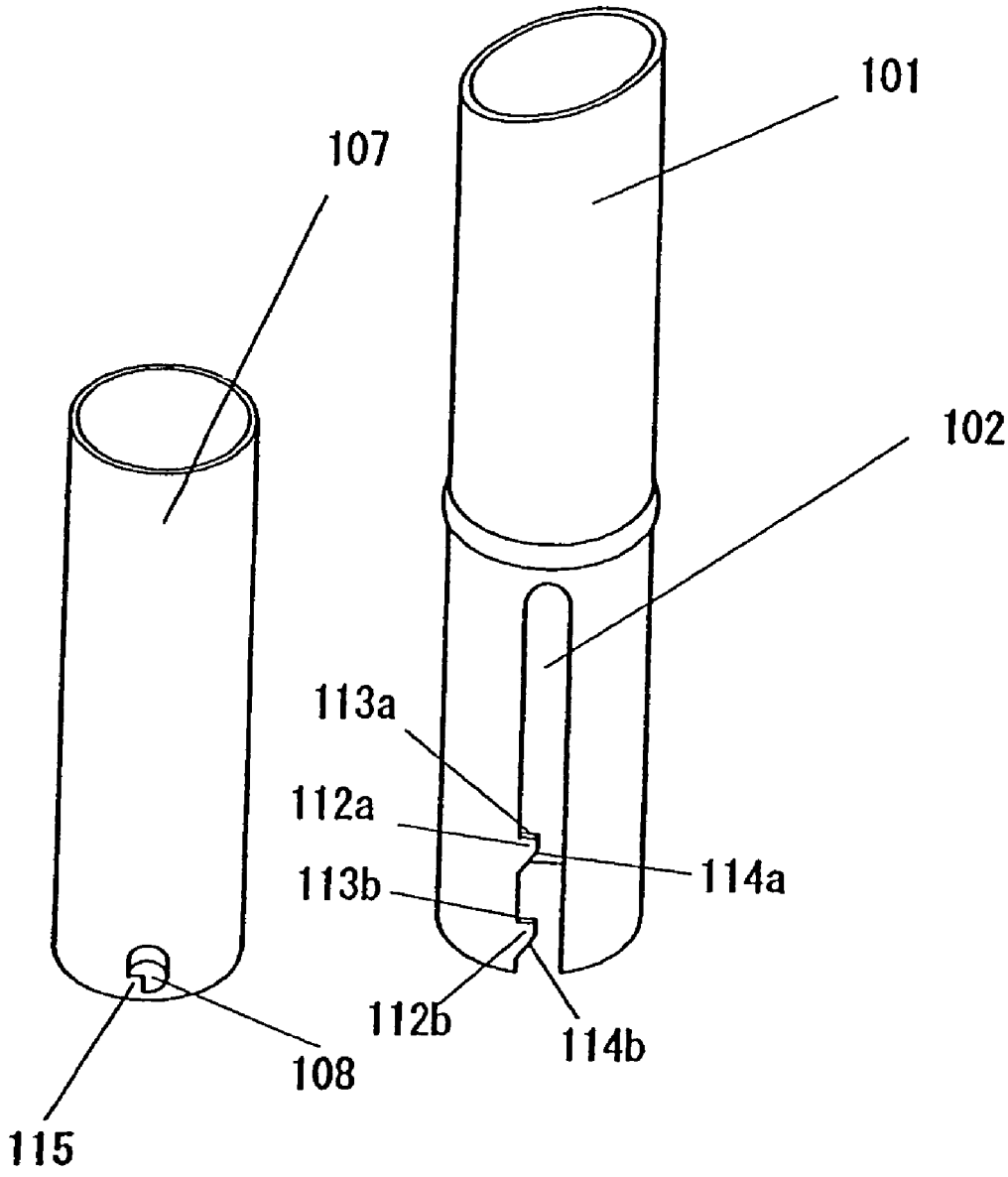
FIG. 21 is a drawing showing the shapes of the sleeve and the inner container used in the stick-type cosmetic container according to the embodiment shown in FIG. 19.

For example, FIG. 19 to FIG. 21 show the configuration in which the locking projections 112 are provided at two levels.

In this configuration, the single small projection 108 is provided on the inner container 107, while the upper locking projection 112*a* and the lower locking projection 112*b* are provided at two levels aligned in the vertical direction, and the respective locking projections are formed respectively with locking surfaces 113*a*, 113*b* and gentle slopes 114*a*, 114*b*.

In the cosmetic storage container having two locking projections aligned in the vertical direction as described above, the cosmetic can be filled from the bottom finely by the following procedure. When filling the cosmetic into the container, as shown in FIG. 19, the inner container 107 is brought down to the position where the small projection 108 is locked with the lower locking projection 112*b*, then sealing device (not shown) is placed on the opening at the distal end of the sleeve 101, and then the sealing device is fixed and sealed. Subsequently, by inverting the cosmetic container so as to be upside down, and filling the stick-type cosmetic in the melted state therein from the bottom, the cosmetic can be filled to the predetermined level, and may be cooled and solidified to mold and prepare the stick-type cosmetic.

The stick-type cosmetic is solidified and molded in this manner. However, when the sealing device for sealing the opening at the distal end of the sleeve 101 having a length corresponding to the distance between the two locking projections is employed, the sealing device is removed once, then the inner container 107 is brought upward until it passes over the position where the small projection 108 is locked with the upper locking projection 112*a* for investigating whether or not there is abnormality in the solidified cosmetic, and then is again brought down. Consequently, the small projection 108 is locked with the upper locking projection 112*a* as shown in FIG. 20, and is stopped and held there. Since the distal end surface of the stick-type cosmetic at this time substantially coincides with the distal end of the sleeve and, in addition, the surface thereof is as smooth as the surface of the sealing device, it can be provided as a final product.

Examples of the sleeve 101 and the inner container 107 used in this configuration are shown in FIG. 21.

Figure 22:
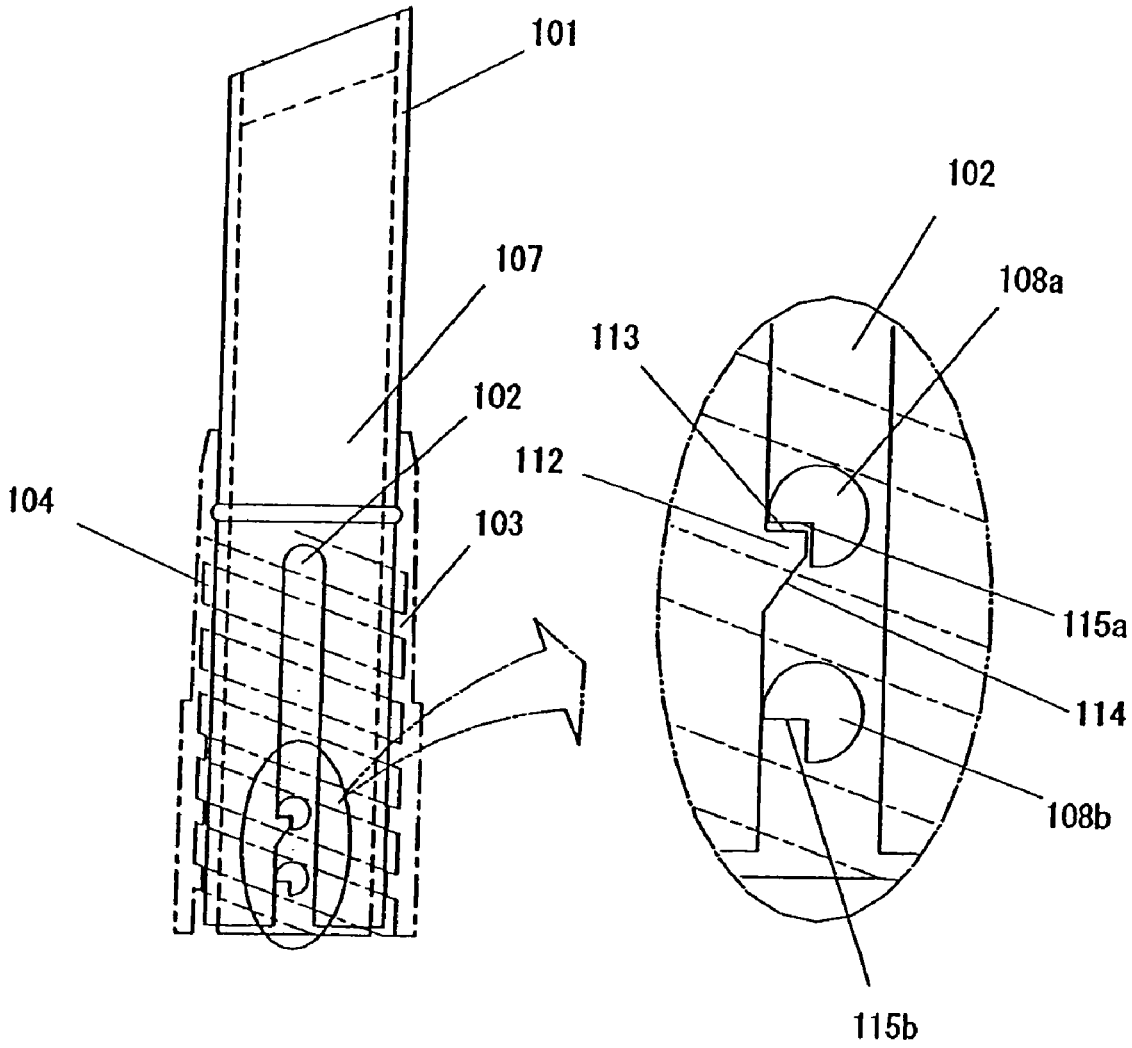
FIG. 22 is a drawing showing the structure in which two small projections are provided. The inner container is located at the lowermost position.
Figure 24:
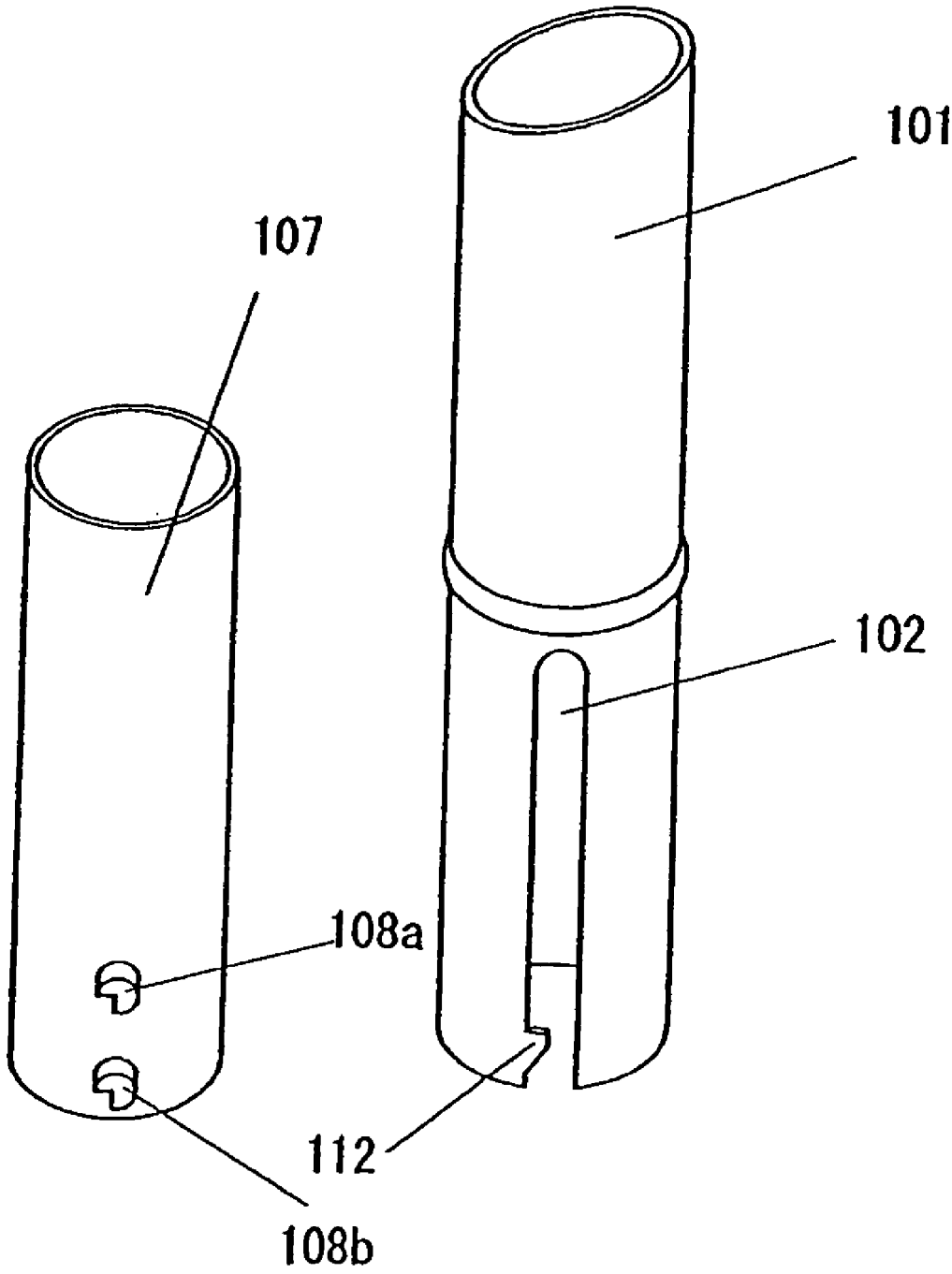
FIG. 24 is a drawing showing the shapes of the sleeves and the inner container used in the stick-type cosmetic container in the embodiment shown in FIG. 22.

As another example of the retaining mechanism in which the plurality of holding positions are provided, a configuration in which two small projections including an upper small projection 108*a* and a lower small projection 108*b* are provided as small projections including the locking notches 115 as shown in FIG. 22 and FIG. 24 may be provided.

The operational mechanism in this configuration is basically the same as the configurations described above, and when filling the cosmetic into the container, the inner container 107 is brought down to the position where the upper small projection 108*a* is locked with the locking projection 112 as shown in FIG. 22, and the sealing device (not shown) is placed on the opening at the distal end of the sleeve 101, and the sealing device is fixed and sealed. Subsequently, by inverting the cosmetic container to be upside down, and filling the stick-type cosmetic in the melted state from the bottom, the cosmetic can be filled to the predetermined level, and may be cooled and solidified to mold and prepare the stick-type cosmetic.

Figure 23:
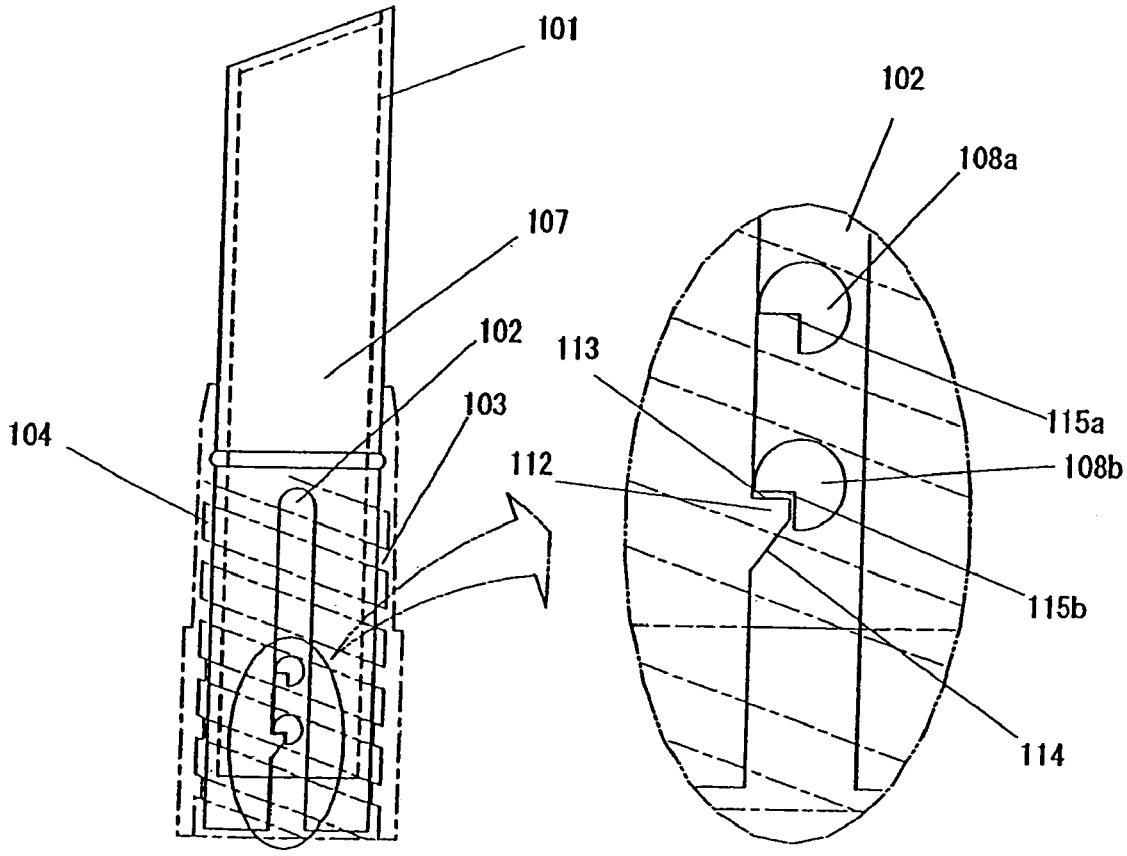
FIG. 23 is a drawing showing a state in which the inner container is at the lowermost position in the normal use in the embodiment shown in FIG. 22.

When the sealing device having a length corresponding to the distance between the two small projections is used when solidifying and molding, the sealing device is removed, the inner container 107 is brought upward until it passes over the position where the lower small projection 108*b* is locked with the locking projection 112 once for investigating whether or not there is abnormality in the solidified cosmetic, and then is again brought down. Consequently, the lower small projection 108*b* is locked with the locking projection 112 as shown in FIG. 23, and is stopped and held there. Since the distal end surface of the stick-type cosmetic at this time substantially coincides with the distal end of the sleeve and, in addition, the surface thereof is as smooth as the surface of the sealing device, it can be provided as a final product.

Examples of the sleeve 101 and the inner container 107 used in this configuration is shown in FIG. 24.

Figure 25:
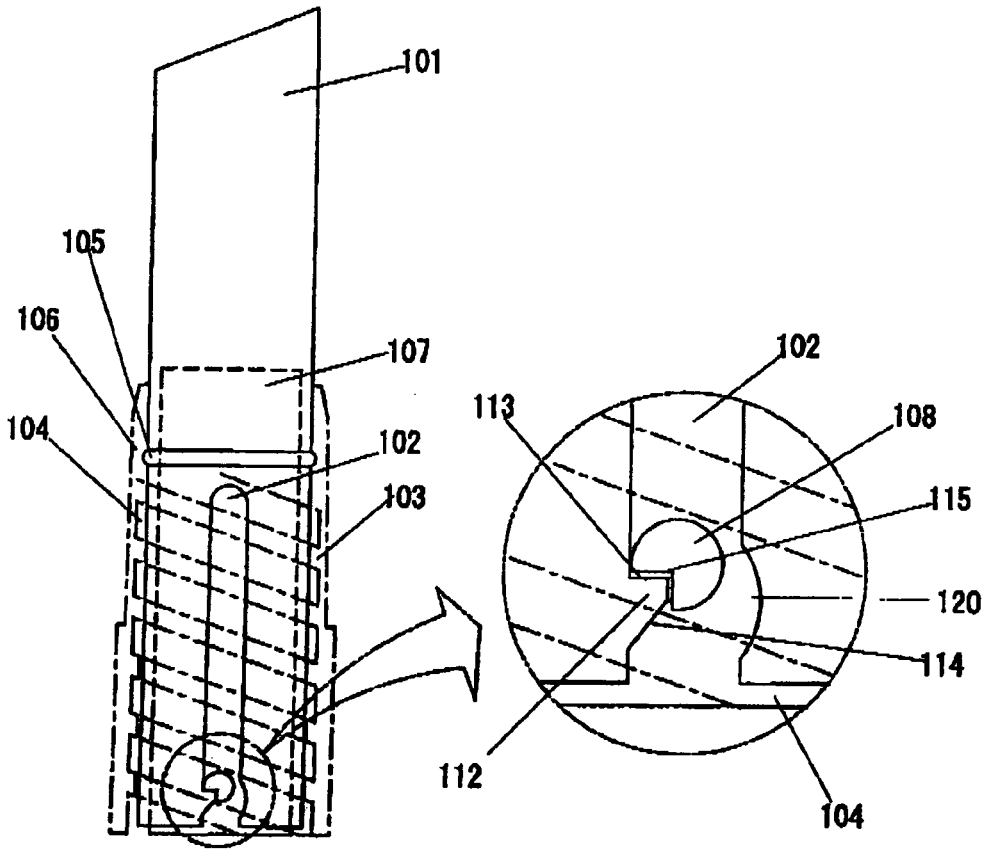
FIG. 25 is a drawing showing a configuration in which part of the inner container guiding groove is notched at the position corresponding to the position of the locking projection on the opposite side.
Figure 26:
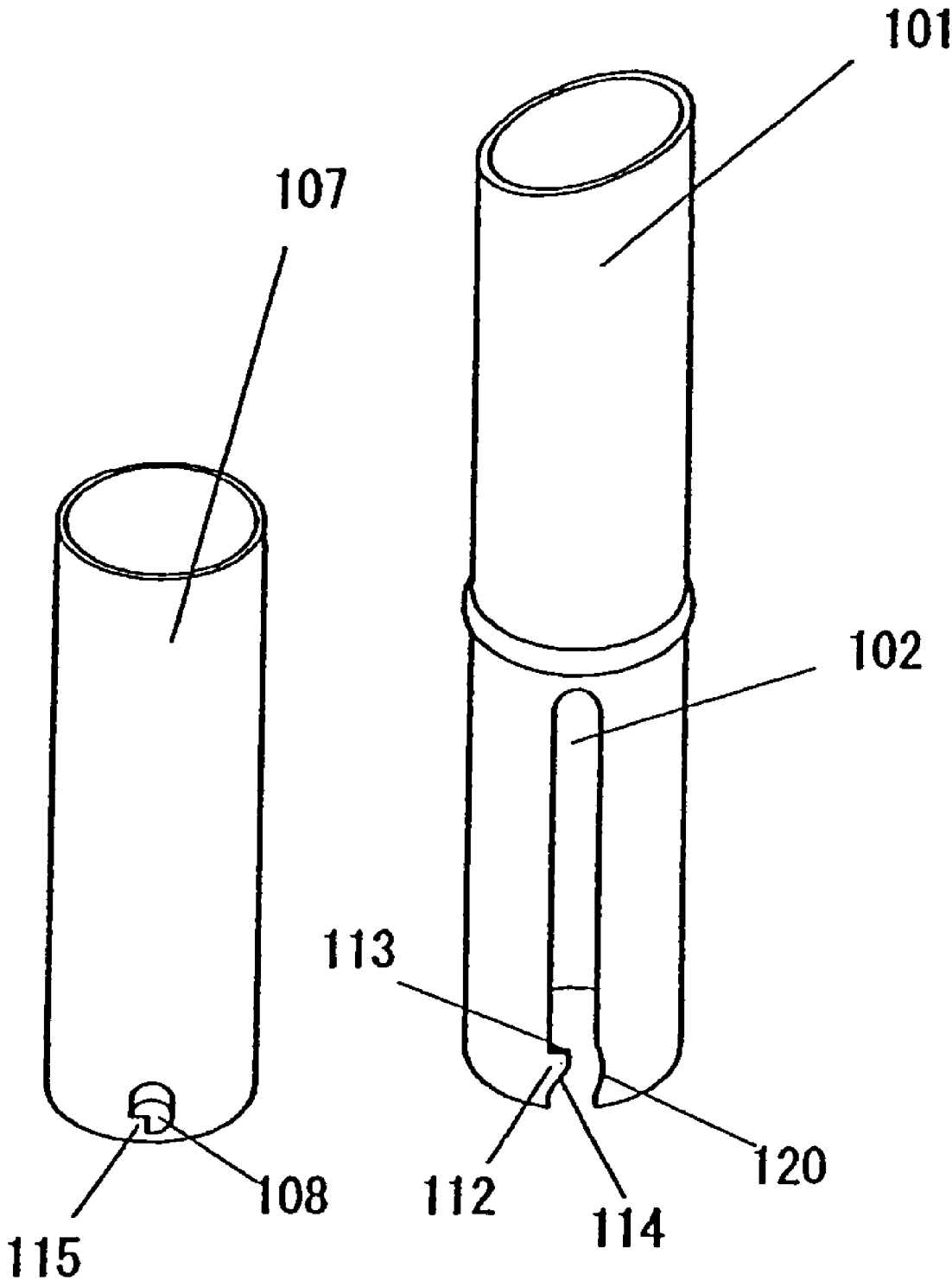
FIG. 26 is a drawing showing the shapes of the sleeves and the inner container used in the stick-type cosmetic container in the embodiment shown in FIG. 25.

In the retaining mechanism including the locking projection 112 and the small projection 108 having the locking notch 115, a recess 120 may be formed by removing part of the inner container guiding groove 102 at the position corresponding to the locking projection 112 on the opposite side as shown in FIG. 25 and FIG. 26.

The recess 120 is formed for facilitating passage of the small projection 108 through the portion of the locking projection 112 when moving the inner container 107 upward, and thus the inner container 107 can easily be mounted into the sleeve 101.

The stick-type cosmetic container of the present invention thus obtained can be prepared as substantially the same products as the stick-type cosmetic container which has been provided in the related art in material, size and shape except for the shape of the sleeve 2 or 101, the fact that the helical groove 11 or 111 on the outer cylinder is formed to the end, and the shape of the small projection according to the second embodiment. In other words, the distal end of the inner container may not be the pointed shape, but may be other shapes, and materials for the sleeve 2 or 101, the inner container 7 or 107, and the outer cylinder 10 or 110 may be various types of metal or plastic as in the related art. In addition, it is also possible to cover or coat the outer surface of the outer cylinder with metal to obtain a decorative cylinder, or to coat the same in various manners. A lid may be provided. Materials to be used for these members maybe paper or ceramics in addition to the metal or plastic, as long as it can keep the shape.

INDUSTRIAL APPLICABILITY

According to the stick-type cosmetic container of the present invention, the inner container does not drop out when in use, but can easily be replaced by the use of a simple jig when the stick-type cosmetic is completely used.

Therefore, it can be effectively used for the cosmetics such as lipstick, lip cream, concealer, skin whitening stick, sun screen stick as a stick-type cosmetic container which realizes resource saving and recycling.

The invention claimed is:

1. A stick-type cosmetic container comprising:

an outer cylinder;

a sleeve;

an inner container configured to contain a stick-type cosmetic; and one or more small projections are provided on the inner container being guided by an inner container guiding groove formed on the sleeve, the small projection moving upward and downward along a helical groove formed on the inner surface of the outer cylinder, wherein a stick-type cosmetic is configured to be filled in the inner container and is configured to be projected and retracted, and wherein the lower end of the inner container guiding groove formed on the sleeve is opened and one or more locking projections corresponding to one or more locking notches formed on the small projection is provided at the lower portion of the inner container guiding groove as a retaining mechanism for the small projection.

2. A stick-type cosmetic container according to claim 1, wherein the locking projection is provided on a side which receives a force when the small projection is moved downward.

3. A stick-type cosmetic container according to claim 1, wherein the locking projection comprises a substantially horizontal surface formed on the upper surface and fitting the locking notch of the small projection and a gentle slope formed on the lower surface.

4. A stick-type cosmetic container according to claim 1, wherein two locking projections are provided at two levels.

5. A stick-type cosmetic container according to claim 1, wherein two small projections having the locking notches are provided.

6. A stick-type cosmetic container according to claim 1, wherein part of the inner container guiding groove is removed at the position corresponding to the locking projection on the opposite side.

7. A method of preparing a stick-type cosmetic, the stick-type cosmetic container including an outer cylinder, a sleeve, an inner container configured to contain a stick-type cosmetic, and a small projection provided on the inner container being guided by an inner container guiding groove formed on the sleeve, the small projection moving upward and downward along a helical groove formed on the inner surface of the outer cylinder, wherein a stick-type cosmetic is configured to be filled in the inner container and is configured to be projected and retracted, wherein the lower end of the inner container guiding groove formed on the sleeve is opened and one or more locking projections corresponding to one or more locking notches formed on the small projection are provided at the lower portion of the inner container guiding groove as a retaining mechanism for the small projection, and wherein two locking projections are provided at two levels, the method comprising:

holding the small projection at the lower locking projection of the locking projections provided at two levels;

mounting the sealing device at the opening of the sleeve; and filling the container.

8. A method of preparing the stick-type cosmetic according to claim 7, further comprising:

using the sealing device having a length corresponding to the distance between the two locking projections.

9. A method of preparing a stick-type cosmetic using a stick-type cosmetic container, the stick-type cosmetic container including an outer cylinder, a sleeve, an inner container configured to contain a stick-type cosmetic, and a small projection provided on the inner container being guided by an inner container guiding groove formed on the sleeve, the small projection moving upward and downward along a helical groove formed on the inner surface of the outer cylinder, wherein a stick-type cosmetic is configured to be filled in the inner container and is configured to be projected and retracted, wherein the lower end of the inner container guiding groove formed on the sleeve is opened and one or more locking projections corresponding to one or more locking notches formed on the small projection are provided at the lower portion of the inner container guiding groove as a retaining mechanism for the small projection, the method comprising:

filling the cosmetic from a bottom of the container.

10. The method of preparing a stick-type cosmetic according to claim 9, further comprising:

positioning the inner container where the small projection is locked with the lower locking projection;

placing the sealing device on the opening at a distant end of the sleeve;

fixing and sealing the sealing device;

inverting the cosmetic container upside down;

cooling and solidifying the cosmetic;

bringing the inner container upward until it passes over the position where the small projection is locked with the upper locking projection; and bringing back down the inner container to lock the small projection with the upper locking projection.

* * * * *

UNITED STATES PATENT AND TRADEMARK OFFICE

CERTIFICATE OF CORRECTION

PATENT NO. : 7,422,387 B2
APPLICATION NO. : 10/522376
DATED : September 9, 2008
INVENTOR(S) : Kurihara et al.

It is certified that error appears in the above-identified patent and that said Letters Patent is hereby corrected as shown below:

On the title page, Item (54), and Column 1, the title is incorrect. Item (54) and Column 1 should read:

-- (54) STICK-TYPE COSMETIC CONTAINER --

Signed and Sealed this

Second Day of December, 2008

JON W. DUDAS
*Director of the United States Patent and Trademark Office*